US007119313B2

(12) United States Patent
Tang et al.

(10) Patent No.: US 7,119,313 B2
(45) Date of Patent: Oct. 10, 2006

(54) APPARATUS AND METHOD FOR HEATING OBJECTS WITH MICROWAVES

(75) Inventors: Juming Tang, Pullman, WA (US); Fang Liu, Pullman, WA (US); Surya Kumar Pathak, Gujarat (IN); Eugene E. Eves, II, Westford, MA (US)

(73) Assignee: Washington State University Research Foundation, Pullman, WA (US)

( * ) Notice: Subject to any disclaimer, the term of this patent is extended or adjusted under 35 U.S.C. 154(b) by 0 days.

(21) Appl. No.: 10/937,547

(22) Filed: Sep. 8, 2004

(65) Prior Publication Data

US 2005/0127068 A1 Jun. 16, 2005

Related U.S. Application Data

(60) Provisional application No. 60/501,585, filed on Sep. 8, 2003.

(51) Int. Cl.
*H05B 6/70* (2006.01)

(52) U.S. Cl. ..... 219/700; 219/697

(58) Field of Classification Search ..... 219/700, 219/746, 697, 709, 701, 687, 726, 745, 696, 219/678, 690; 426/237, 241, 244
See application file for complete search history.

(56) References Cited

U.S. PATENT DOCUMENTS

| | | | | |
|---|---|---|---|---|
| 3,398,251 | A * | 8/1968 | Jeppson et al. | 219/686 |
| 3,809,845 | A | 5/1974 | Stenstrom | |
| 4,775,770 | A | 10/1988 | Fritz | |
| 4,808,782 | A | 2/1989 | Nakagawa et al. | |
| 4,866,233 | A | 9/1989 | Fritz | |
| 4,952,763 | A | 8/1990 | Fritz | |
| 4,956,530 | A | 9/1990 | Koch | |
| 5,066,503 | A | 11/1991 | Ruozi | |
| 5,796,080 | A | 8/1998 | Jennings et al. | |
| 5,834,744 | A * | 11/1998 | Risman | 219/697 |
| 5,910,268 | A | 6/1999 | Keefer | |
| 6,020,580 | A | 2/2000 | Lewis et al. | |
| 6,120,741 | A | 9/2000 | Jacquault et al. | |
| 6,268,596 | B1 | 7/2001 | Lauf | |
| 6,323,471 | B1 | 11/2001 | Yagi | |
| 6,323,473 | B1 | 11/2001 | Yamamoto et al. | |
| 2002/0046474 | A1 | 4/2002 | Novak et al. | |

OTHER PUBLICATIONS

Collins, Michael J., "Drug Discovery at the Speed of Light," available at www.rdmag.com/features/0112cem.asp (publication date unknown).

Ferrite R&D Applications, Post Pasteurization-MES03 Development System, www.ferriteinc.com/mes03.html (system publicly used at least prior to Sep. 8, 2002).

Guan, Dongsheng et al., "Sensory Evaluation of Microwave Treated Macaroni and Cheese," *Journal of Food Processing and Preservation,* vol. 26, No. 5, pp. 307-321 (Dec. 2002).

(Continued)

*Primary Examiner*—Quang Van
(74) *Attorney, Agent, or Firm*—Klarquist Sparkman, LLP

(57) ABSTRACT

Apparatus for pasteurizing and/or sterilizing foodstuffs. In one representative embodiment, an apparatus for pasteurizing or sterilizing a packaged foodstuff includes at least one cavity in which the foodstuff to be pasteurized or sterilized is positioned. The cavity is configured such that, as microwave energy radiates into the cavity, the cavity operates as a single-mode cavity for sterilizing or pasteurizing the foodstuff. In another embodiment, methods are provided for optimizing a microwave system for sterilizing or pasteurizing a foodstuff.

19 Claims, 25 Drawing Sheets

OTHER PUBLICATIONS

Hawkins, Robert et al., "Further Developments on Applying Generic Task Approaches to the Industrial Process Control Problem," (publication date unknown).
"Kinetics of Microbial Inactivation of Alternative Food Processing Technologies," U.S. Food and Drug Administration, Center for Food Safety and Applied Nutrition (Jun. 2, 2000).
Mermelstein, Neil H., "Microwave Processing of Food," in *Products and Technologies Processing,* vol. 53, No. 7 (Jul. 1999).
Ohlsson, T., "Sterilization of Food By Microwave," presented at the International Seminar on New Trends in Aseptic Processing and Packaging of Foodstuffs, Munich, Oct. 22-23, 1987.
"Scientists Work to Make Better Tasting Military Rations," available at http://wsunews.wsu.edu/detail.asp?storyID=569 (Oct. 23, 2001).
Thayer, Donald W. et al., "Radiation Pasteurization of Food," in CAST, Issue Paper No. 7 (Apr. 1996).

* cited by examiner

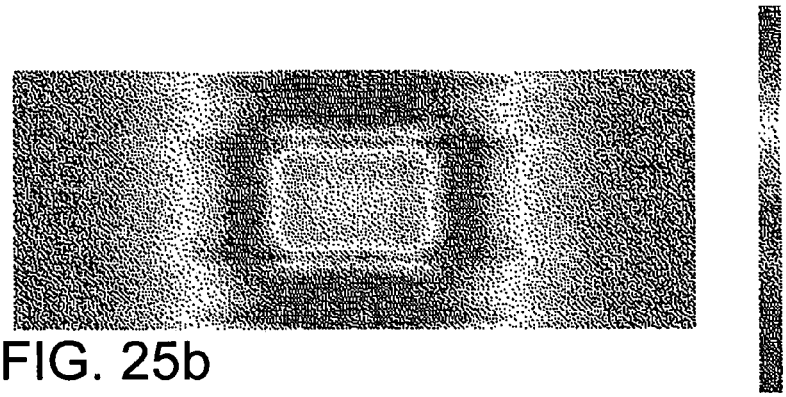
FIG. 25b
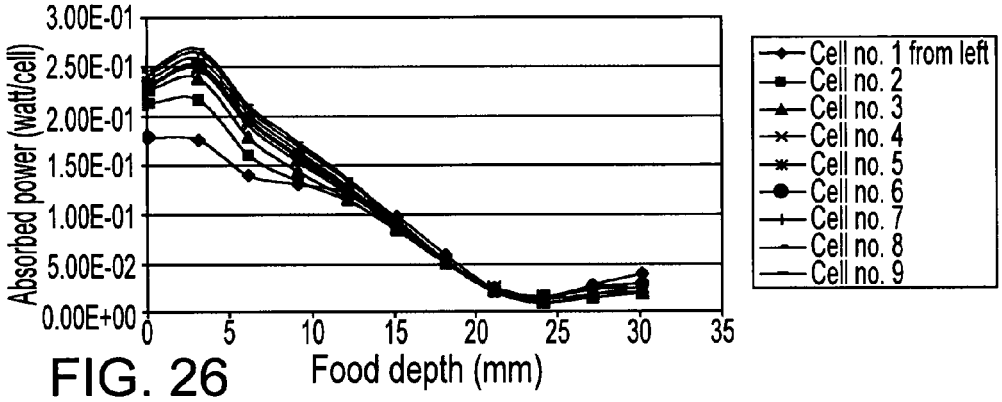
FIG. 26
FIG. 27
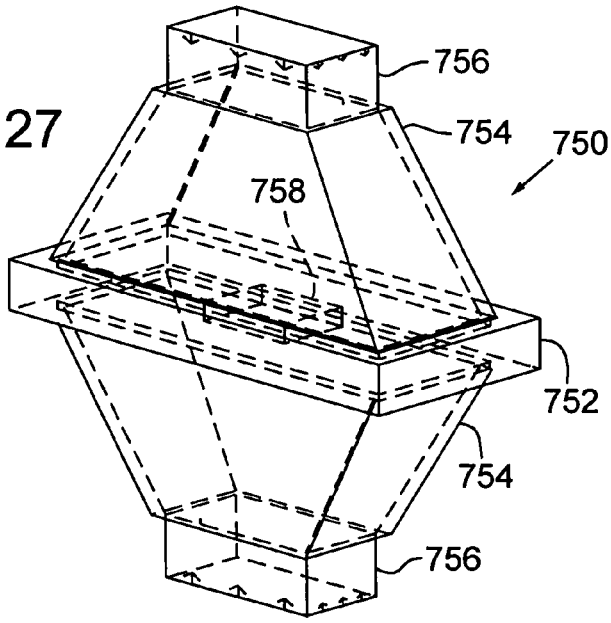

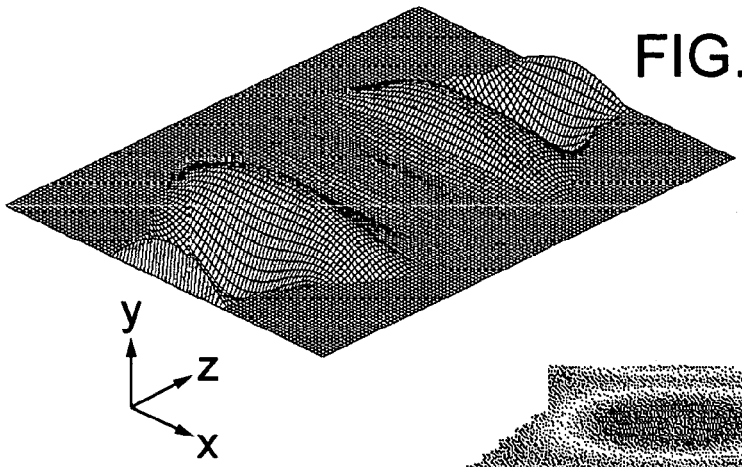
FIG. 29a
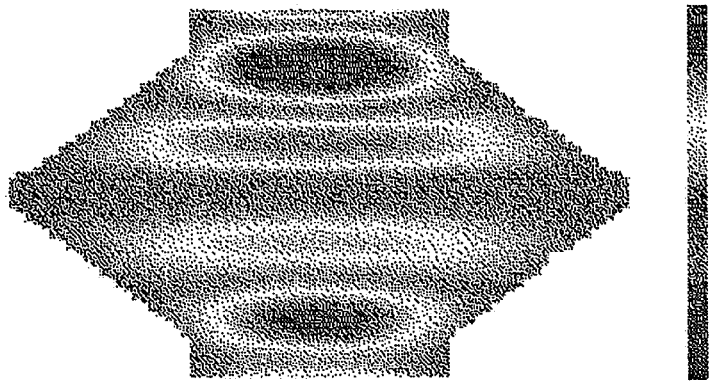
FIG. 29b
FIG. 30a
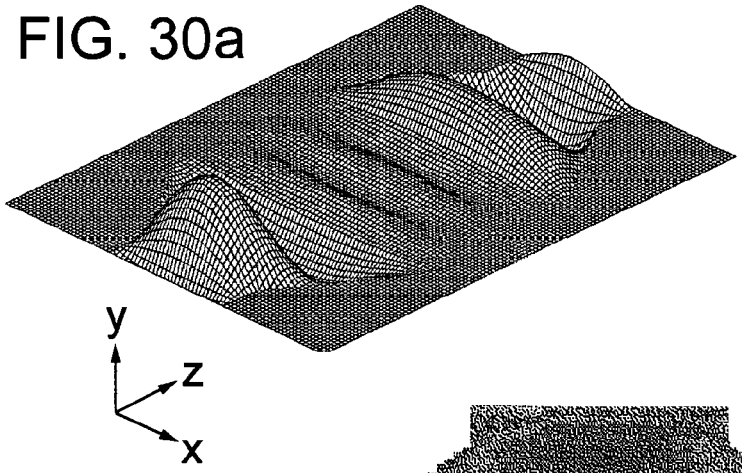
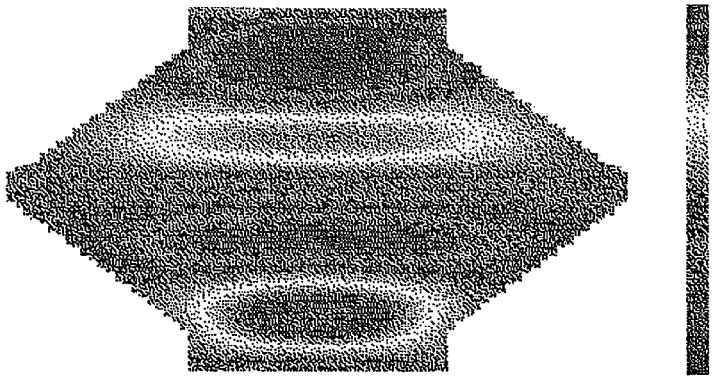
FIG. 30b

APPARATUS AND METHOD FOR HEATING OBJECTS WITH MICROWAVES

CROSS REFERENCE TO RELATED APPLICATION

The present application claims the benefit of U.S. provisional application No. 60/501,585, file Sep. 8, 2003, which is incorporated herein by reference.

FEDERAL GRANT

This invention was developed with support under Grant Numbers DAAK60-97-P-4627, DAAN02-98-P-8380, and DAAD16-00-C-97240 from the U.S. Army Natick Soldier Center and Grant Number DAAD16-01-2-0001 from the U.S. Department of Defense.

FIELD

The present invention relates to embodiments of apparatus and methods for heating objects, such as foodstuffs, with microwaves. In particular, the present invention relates to the use of microwave heating for pasteurizing and/or sterilizing foodstuffs.

BACKGROUND

In food processing, foodstuffs can be pasteurized and/or sterilized to reduce the occurrence of food-borne diseases caused by harmful microorganisms. Pasteurization involves heating foodstuffs to a temperature, typically between 80° C. to 100° C., sufficient to kill certain pathogenic bacteria and microorganisms. In sterilization, foodstuffs are heated to a higher temperature, typically between 100° C. to 140° C., to ensure elimination of more resistant microorganisms. Sterilization allows normally perishable foodstuffs to be stored at room temperature for extended periods of time. Sterilized foodstuffs distributed for long-term preservation at room temperature are known as "shelf-stable" foods.

Traditional methods for pasteurizing and sterilizing foodstuffs involve the use of conventional heating processes (i.e., heating via the transfer of thermal energy from a high-temperature medium to a low-temperature substance), such as heating foodstuffs with hot air, hot water, or vapor. More recently, microwave heating has been employed for pasteurizing and sterilizing foodstuffs. Microwave heating is advantageous in that pasteurization and/or sterilization can be achieved in a much shorter time than is possible by conventional heating processes. By decreasing sterilization time, foodstuffs generally taste better and nutrient retention is improved. In addition, microwave systems typically are more energy-efficient than conventional heating systems.

However, attempts at commercializing microwave pasteurization and sterilization processes have had limited success. Some reasons for the lack of success in commercial operation are complexity, expense, non-uniformity of heating, and inability to ensure sterilization of the entire package. Thus, a need exists for new apparatus for pasteurizing and/or sterilizing foodstuffs, and methods for their use.

SUMMARY

The present disclosure concerns microwave heating, and in particular, apparatus and methods for pasteurizing and/or sterilizing foodstuffs in the food processing industry.

In one representative embodiment, an apparatus for pasteurizing or sterilizing a packaged foodstuff includes at least one cavity in which the foodstuff to be pasteurized or sterilized is positioned. The cavity is configured such that, as microwave energy radiates into the cavity, the cavity operates as a single-mode cavity for sterilizing or pasteurizing the foodstuff.

In another representative embodiment, an apparatus for heating an object utilizing microwaves includes at least one cavity for receiving the object to be heated. The cavity comprises a liquid-tight cavity and has first and second microwave-transparent windows on opposing sides thereof. A first applicator is positioned adjacent the first microwave-transparent window for directing microwaves into the cavity in a first direction. A second applicator is positioned adjacent the second microwave-transparent window for directing microwaves into the cavity in a second direction opposite the first direction. A pressurized-liquid source is configured to deliver a pressurized liquid to the cavity for immersing the object in the liquid during microwave heating.

In still another representative embodiment, a system for pasteurizing or sterilizing a packaged foodstuff utilizing microwaves includes a pre-heating section for pre-heating the foodstuff using conventional heating. A microwave-heating section is provided for heating the foodstuff for a predetermined time period using microwave heating. The microwave-heating section includes at least one microwave cavity that is operable as a single-mode cavity when microwaves are directed into the cavity for heating the foodstuff. The system also includes a holding section and a cooling section downstream of the microwave-heating section. In the holding section, the foodstuff is heated to substantially maintain the pasteurization or sterilization temperature of the foodstuff until the foodstuff is pasteurized or sterilized. In the cooling section, the foodstuff is cooled to a reduced temperature (e.g., about room temperature) for further handling or processing.

In another representative embodiment, a method for pasteurizing or sterilizing a packaged foodstuff includes placing the foodstuff in a microwave cavity, propagating microwaves into the cavity so as to establish a single-mode microwave energy desposition in the cavity, and heating the foodstuff with the microwaves to either pasteurize or sterilize the foodstuff.

In another representative embodiment, a method for processing a packaged foodstuff includes placing the foodstuff in a microwave cavity and pressurizing the inside of the microwave cavity with a liquid. Microwaves are then simultaneously propagated into the cavity in first and second, opposing directions so that microwaves are absorbed on at least two sides of the foodstuff.

In another representative embodiment, an apparatus for heating an object utilizing microwaves comprises at least a first and a second microwave cavity. The first cavity is in communication with the second cavity. A first waveguides is configured to direct microwaves into the first cavity to establish a first mode therein. A second waveguide is configured to direct microwaves into the second cavity to establish a second mode therein. The first mode is different than the second mode. Thus, an object, such as a foodstuff, being conveyed through the cavities is exposed to two different modes or field configurations.

The foregoing and other features and advantages of the invention will become more apparent from the following detailed description of several embodiments, which proceeds with reference to the accompanying figures.

BRIEF DESCRIPTION OF THE DRAWINGS

FIG. 20*a* shows a power-deposition profile for the load when surrounded by air. FIG. 20*b* shows a power-deposition profile for the load when immersed in water.

FIG. 25*b* is a computer simulation of the power-deposition profile over the bottom surface of a load heated in the cavity of FIG. 24*a*.

FIG. 26 shows the simulated absorbed-power distribution across the depth of the load shown in FIGS. 25*a* and 25*b*.

FIG. 27 is a schematic illustration of a system having a rectangular microwave cavity and first and second horn-shaped applicators positioned on opposing sides of the cavity.

FIG. 29*a* is a computer simulation of the propagation characteristics of the fundamental mode in the system shown in FIG. 27 when there is a 90° phase difference between the waves from the opposing applicators.

FIG. 29*b* is a computer-simulated thermal representation of the fundamental mode in the system of FIG. 27 when there is a 90° phase difference between the waves from the opposing applicators.

FIG. 30*a* is a computer simulation of the propagation characteristics of the fundamental mode in the system shown in FIG. 27 when there is a 180° phase difference between the waves from the opposing applicators.

FIG. 30*b* is a computer-simulated thermal representation of the fundamental mode in the system of FIG. 27 when there is a 180° phase difference between the waves from the opposing applicators.

DETAILED DESCRIPTION

As used herein, the singular forms "a," "an," and "the" refer to one or more than one, unless the context clearly dictates otherwise.

As used herein, the term "includes" means "comprises."

As used herein, a group of individual members stated in the alternative includes embodiments relating to a single member of the group or combinations of multiple members. For example, the term "applicator, cavity, or waveguide," includes embodiments relating to "applicator," "cavity," "waveguide," "applicator and cavity," "applicator and waveguide," "cavity and waveguide," and "applicator, cavity, and waveguide."

System for Pasteurizing and/or Sterilizing Foodstuffs

Figure 1:
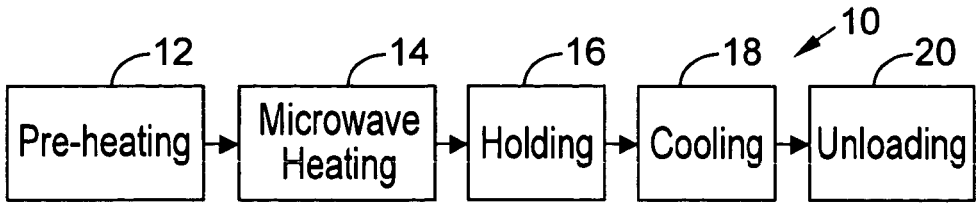
FIG. 1 is a block diagram illustrating one embodiment of a system for pasteurizing and/or sterilizing foodstuffs.

FIG. 1 illustrates schematically one embodiment of a system, indicated generally at 10, for pasteurizing and/or sterilizing foodstuffs. The system 10 in the illustrated embodiment includes a pre-heating section 12, a microwave-heating section 14, a holding section 16, a cooling section 18, and an unloading section 20. In particular embodiments, the pre-heating section 12, the microwave-heating section 14, the holding section 16, and the cooling section 18 comprise respective chambers for heating or cooling foodstuffs therein. In alternative embodiments, one or more of the pre-heating section 12, the microwave-heating section 14, the holding section 16, and the cooling section 18 can include a plurality of discrete chambers. For example, the pre-heating section 12 can include two or more discrete pre-heating chambers.

In some embodiments, the system 10 is configured as a continuous-feed system, in which foodstuffs placed in the pre-heating section 12 are automatically conveyed by one or more conveyors or similar mechanism through the pre-heating section 12, the microwave-heating section 14, the holding section 16, the cooling section 18, and the unloading section where foodstuffs are removed from the system for further processing or packaging. The system 10 can include gates or doors positioned between adjacent sections to provide a barrier between the atmospheres in adjacent chambers. The gates of a chamber can be controlled to remain closed while a foodstuff is in the chamber, and to open long enough to allow the foodstuff to be conveyed into an adjacent chamber.

In the pre-heating section 12, a foodstuff is heated using conventional heating to raise the temperature of the foodstuff to a prescribed temperature, which can be, for example, a temperature in the range of about 40° C. to 90° C. In particular embodiments, the pre-heating section comprises a chamber (not shown), in which the foodstuff is exposed to a heating medium, such as hot water, steam, or hot air. In the microwave-heating section 14, the foodstuff is heated in a microwave cavity (described below) using microwave energy to further raise the temperature of the foodstuff to a prescribed end temperature at which pasteurization and/or sterilization can occur (e.g., 80° C. to 100° C. if the foodstuff is to be pasteurized or 100° C. to 140° C. if the foodstuff is to be sterilized). Of course, since sterilization occurs at a higher temperature than pasteurization, a foodstuff that is sterilized will also be pasteurized.

In the holding section 16, the temperature of the foodstuff is maintained at the end temperature for a period of time sufficient to ensure pasteurization or sterilization of the foodstuff. Microwave energy and/or conventional heating can be used to maintain the temperature of the foodstuff in the holding section 16. For example, in particular embodiments, the holding section comprises a chamber in which the foodstuff is exposed to a heating medium, such as hot water, steam, or hot air, and is irradiated with microwave energy.

In the cooling section 18, the foodstuff is exposed to a cooling medium (e.g., a flow of water or air) to bring the temperature of the foodstuff down to a reduced temperature (e.g., room temperature) for further processing or handling.

In particular embodiments, one or more of the pre-heating section 12, the microwave-heating section 14, the holding section 16, and the cooling section 18 comprise pressure-tight and fluid-tight chambers that are pressurized to balance the vapor pressure generated in the package containing the foodstuff, and therefore prevent bursting or opening of the package. In certain embodiments, chambers pressurized to about 30 psig were suitable to prevent bursting or opening of the food package. However, the pressure in each section can be varied depending on the temperature of the foodstuff in each section and other process variables.

Pressurization in any section of the system 10 can be achieved in any suitable manner. For example, the heating or cooling medium of a particular section of the system 10 can be used to pressurize that section of the system 10. In one embodiment, for example, the microwave-heating section 14 comprises a pressure-tight and fluid-tight chamber having an inlet for receiving a pressurized fluid (e.g., hot water, steam, or other heating medium) and an outlet for discharging the pressurized fluid. The pressurized fluid serves to pressurize the inside of the chamber, thereby preventing the foodstuff from bursting, and to assist in heating the foodstuff.

In other embodiments, the atmosphere inside a chamber can be pressurized with a compressed gas (e.g., air), in which case a separate heating/cooling medium may be used for heating/cooling the foodstuff. Also, in such embodiments, since a separate fluid is used to pressurize the chamber, the heating/cooling medium itself can be non-pressurized. In one implementation, for example, the pre-heating section 12 comprises an air-tight chamber that is pressurized with compressed air. To heat the foodstuff, the foodstuff is immersed in a heating medium (e.g., a pool of hot water) inside the chamber.

In alternative embodiments, one or more of the pre-heating section, holding section, or cooling sections can be eliminated. Also, additional sections can be added to the system 10. In particular embodiments, for example, foodstuffs can be heated in an equilibration section (not shown) following heating in the microwave-heating section 14 and prior to heating in the holding section 16. In the equilibration section, the foodstuff is exposed to a heating medium (e.g., hot air) to equilibrate the temperatures and reduced uniformities within the foodstuff.

Embodiments of Microwave-Heating Apparatus

Embodiments of microwave-heating apparatus that can be implemented in a pasteurization/sterilization system, such as the system 10 of FIG. 1, will now be described.

Figure 2:
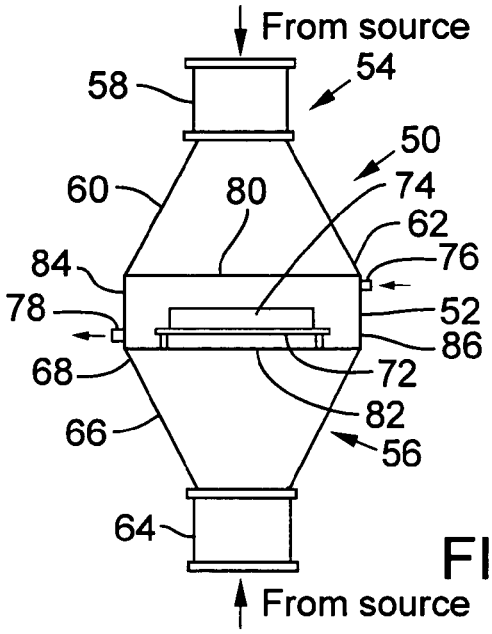
FIG. 2 is a schematic illustration of a microwave-heating apparatus, according to one embodiment.

Referring to FIG. 2, there is shown a microwave-heating apparatus 50, according to one embodiment, that includes a microwave cavity 52, a first waveguide 54 for directing microwaves from a microwave source (not shown) to the cavity 52, and a second waveguide 56 for directing microwaves from a microwave source (not shown) to the cavity 52. In other embodiments, the microwave apparatus can have only one of the waveguides 54, 56 so that microwaves are directed into the cavity from only one direction. Positioned in the cavity 52 is a support stand 72 for supporting a foodstuff 74 to be irradiated by microwaves introduced into the cavity by the waveguides 54, 56. The support stand 72 desirably is open at the bottom to allow irradiation of the top and bottom of the foodstuff 74 and to allow a fluid medium in the cavity 52 to contact substantially the entire surface of the foodstuff.

In an alternative embodiment, the second waveguide 56 can be replaced with a reflector (e.g., a metal plate) positioned opposite the first waveguide 54. In this alternative embodiment, microwaves propagating into the cavity and not absorbed by the foodstuff 74 are reflected back in the opposite direction toward the first waveguide 54.

A single microwave source can be used for supplying microwaves to both the first and second waveguides 54, 56. Alternatively, a separate microwave source can be used for supplying each waveguide 54, 56. In any event, the microwave source(s) (not shown) can be any suitable mechanism that produces electromagnetic radiation in the microwave range. Without limitation, the microwave source(s) can be, for example, one or more magnetrons, klystrons, electronic oscillators, and/or solid-state sources.

The waveguide 54 includes a first waveguide section 58 and a second waveguide section 60, both coupled to respective sources or to a single source. The second waveguide section 60 has an enlarged end 62 adjacent one side of the cavity 52 (which is the top side of the cavity 52 in the illustrated embodiment). Similarly, the waveguide 56 includes a first waveguide section 64 coupled to the microwave source and a second waveguide section 66. The second waveguide section 66 has an enlarged end 68 adjacent the side of the cavity 52 opposite waveguide section 60 of the first waveguide 54 (which is the bottom side of the cavity 52 in the illustrated embodiment). The waveguide sections 60, 66 can be referred to as "microwave applicators" because they apply or direct microwaves into the cavity 52. As shown, the waveguide sections 60, 66 are positioned to direct microwaves into the cavity 52 in opposite directions so as to simultaneously irradiate the top and bottom of the foodstuff 74.

In particular embodiments, the waveguide sections 58, 64 have a generally rectangular transverse cross-sectional profile that is substantially constant along the lengths of the waveguide sections 58, 64. Alternatively, the waveguide sections 58, 64 can have circular transverse cross-sections, square transverse cross-sections, or various other geometric shapes.

Figure 3:
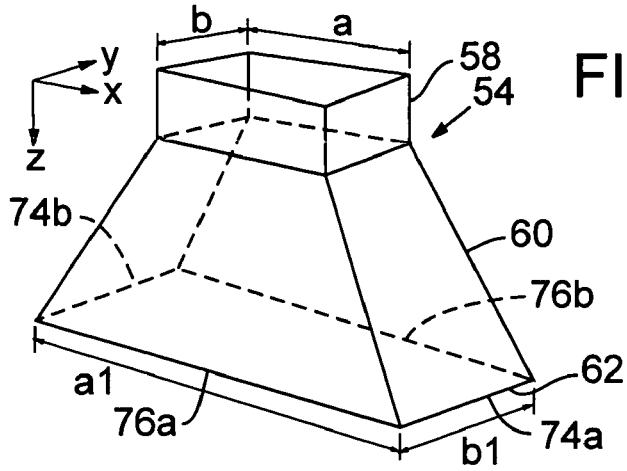
FIG. 3 is a schematic, perspective view of a waveguide, according to one embodiment.
Figure 4:
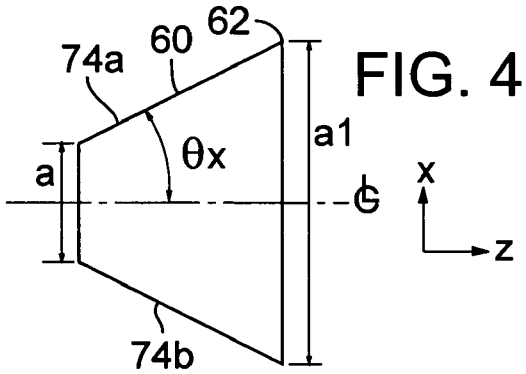
FIG. 4 is a schematic, side view of the waveguide of FIG. 3, illustrating the flare angle of two opposing, broad side walls of the waveguide.
Figure 5:
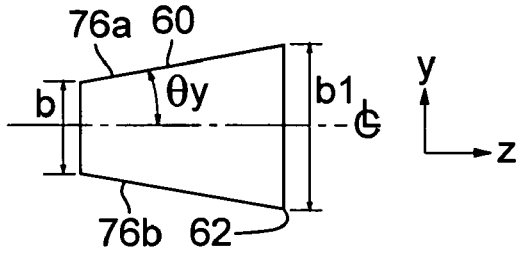
FIG. 5 is a schematic, side view of the waveguide of FIG. 3, illustrating the flare angle of the two opposing, narrow side walls of the waveguide.

FIGS. 3–5 better illustrate the construction of the first waveguide 54. In the illustrated embodiment, the second waveguide 56 is identical in construction to the first waveguide 54. Hence, the following description of the first waveguide 54 also applies to the second waveguide 56. As shown in FIGS. 3–5, waveguide section 60 in the illustrated embodiment has flared side walls 74*a* and 74*b* and flared side walls 76*a* and 76*b*. The side walls 74*a* and 74*b* define a width of the waveguide section 60 (measured in the x-axis direction) that increases from a width a adjacent the first waveguide section 58 to a width a1 at the enlarged end 62. The side walls 76*a*, 76*b* define a depth of the waveguide section 60 (measured in the y-axis direction) that increases from a depth b adjacent the first waveguide section 58 to a depth b1 at the enlarged end 62. In alternative embodiments, the waveguide section 60 can have a flared width and constant depth or flared depth and a constant width. A waveguide section that has a flared width and/or depth is generally known as a "horn" or "horn-shaped" microwave applicator.

The waveguide section 60 has a flare angle $\theta_x$ defined between a longitudinal axis L of the waveguide section 60 and each side wall 74*a*, 74*b* (FIG. 4), and a flare angle $\theta_y$ defined between the longitudinal axis L and each side wall 76*a*, 76*b* (FIG. 5). The flare angles $\theta_x$, $\theta_y$ desirably are minimized (e.g., 30° or less) to preserve the $TE_{10}$-mode characteristics of the propagated mode in the cavity 52. In particular embodiments, for example, the flare angle $\theta_x$ is 17.2° and the flare angle $\theta_y$ is 5.89°, although the flare angles can be varied.

In particular embodiments, the cavity 52 is configured to operate as a single-mode cavity. As used herein, the phrase "single-mode cavity" refers to a microwave cavity in which the superposition of incident and reflected microwaves propagating through the cavity gives rise to a standing-wave pattern having only one field configuration. The wave pattern in a single-mode cavity can have multiple modes.

As demonstrated in the examples below, when foodstuff surrounded by air is heated with microwaves, there is a tendency for uneven heating of the foodstuff. Uneven heating likely is caused by the reflection and refraction of microwaves at the interfaces between the foodstuff and the surrounding air, and the discontinuity of the electric- and magnetic-field components at the food-air boundaries of the food package. In some cases, the periphery of the foodstuff absorbs more microwave energy than the center of the foodstuff. This phenomenon is known as "edge heating." To improve heating uniformity and reduce the effects of edge heating, the foodstuff can be immersed during microwave heating in a fluid medium having a dielectric constant that is greater than air. Generally, heating uniformity improves as the dielectric constant approaches that of the foodstuff. Hence, it is desirable to select a fluid medium having a dielectric constant that is equal to or substantially equal to the dielectric constant of the foodstuff to be heated. The fluid medium can be, for example, a liquid such as water.

As shown in FIG. 2, the cavity 52 in the illustrated embodiment is provided with a fluid inlet 76 for receiving a fluid medium and a fluid outlet 78 for discharging the fluid medium. The locations of the fluid inlet and the fluid outlet may vary, but desirably are situated to provide a relatively uniform flow pattern around the foodstuff. The upper and lower walls 80 and 82, respectively, of the cavity 52 desirably are made from a microwave-transparent, fluid-impermeable, and mechanically strong material to contain the fluid medium in the cavity 52 while permitting microwaves to enter the cavity 52 from the waveguide applicators 60, 66. In particular embodiments, for example, the walls 76, 78 comprise 12.5-mm to 25-mm thick Plexiglas® or Ultem®.

In one implementation, the foodstuff 74 is partially or completely immersed in a pressurized fluid medium flowing through the cavity 52 from inlet 76 to outlet 78 as the foodstuff is being heated with microwaves. The fluid medium desirably is pre-heated to a temperature at or above the desired heating temperature (e.g., about 80° C. to about 100° C. for pasteurization or about 100° C. to about 140° C. for sterilization) to assist in heating the foodstuff 74. The cavity 52 desirably is fluid-tight up to a specified pressure above atmospheric pressure (e.g., 30 psig) so that the fluid medium can be used to pressurize the inside of the cavity 52 to prevent bursting of the foodstuff 74 during microwave heating. In an alternative implementation, instead of flowing a fluid medium through the cavity 52, the foodstuff 74 can be heated in a non-flowing bath or pool of the fluid medium.

The apparatus 50 can be used as the microwave-heating section in a larger pasteurization/sterilization system, such as the system 10 shown in FIG. 1. In this regard, a side wall 84 of the cavity 52 can be configured to open and close to receive foodstuffs 74 from an upstream section (e.g., preheating section 12). Similarly, a side wall 86 of the cavity 52 can be configured to open and close to permit passage of foodstuffs 74 from the cavity 52 to a downstream section (e.g., holding section 16).

Figure 6:
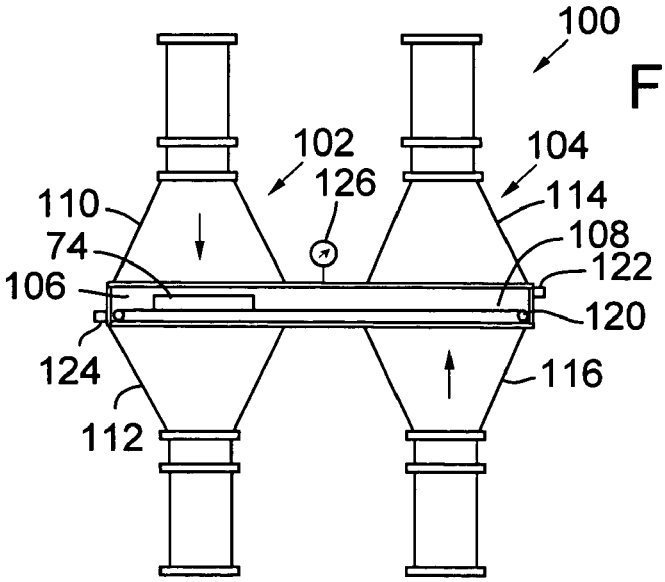
FIG. 6 is a schematic illustration of a microwave-heating apparatus, according to another embodiment.

Referring to FIG. 6, there is shown a microwave-heating apparatus, indicated generally at 100, comprising a first microwave unit 102 and a second microwave unit 104. Each microwave unit 102, 104 can have a construction similar to the microwave apparatus 50 of FIG. 2. As shown, each microwave unit 102, 104 has a respective cavity 106, 108 in which a foodstuff 74 is heated. The microwave unit 102 includes a pair of opposing applicators 110, 112 positioned on opposite sides of the cavity 106. Similarly, the microwave unit 104 includes a pair of opposing applicators 114, 116 positioned on opposite sides of the cavity 108. In particular embodiments, the applicators 110 and 112 are connected to a first microwave source (not shown) and the applicators 114 and 116 are connected to a second microwave source (not shown). In some embodiments, all of the applicators 110, 112, 114, and 116 receive microwaves from a single microwave source. Further alternatively, each applicator 110, 112, 114, and 116 can receive microwaves from a respective microwave source.

The cavities 106, 108 in the illustrated configuration are in communication with each other to permit the foodstuff 74 to travel between the cavities during microwave heating. The apparatus 100 can have a conveyor 120 to automatically move the foodstuff 74 between the cavities 106, 108. The microwave apparatus 100 can have a fluid inlet 122 and fluid outlet 124 to permit a fluid medium to flow through the cavities 106, 108 for immersing the foodstuff 74. A pressure gauge 126 can be mounted at a convenient location for providing a visual indication of the pressure inside the cavities 106, 108.

In alternative embodiments, one of applicators of one or both of the microwave units 102, 104 can be replaced with a reflector.

Figure 7:
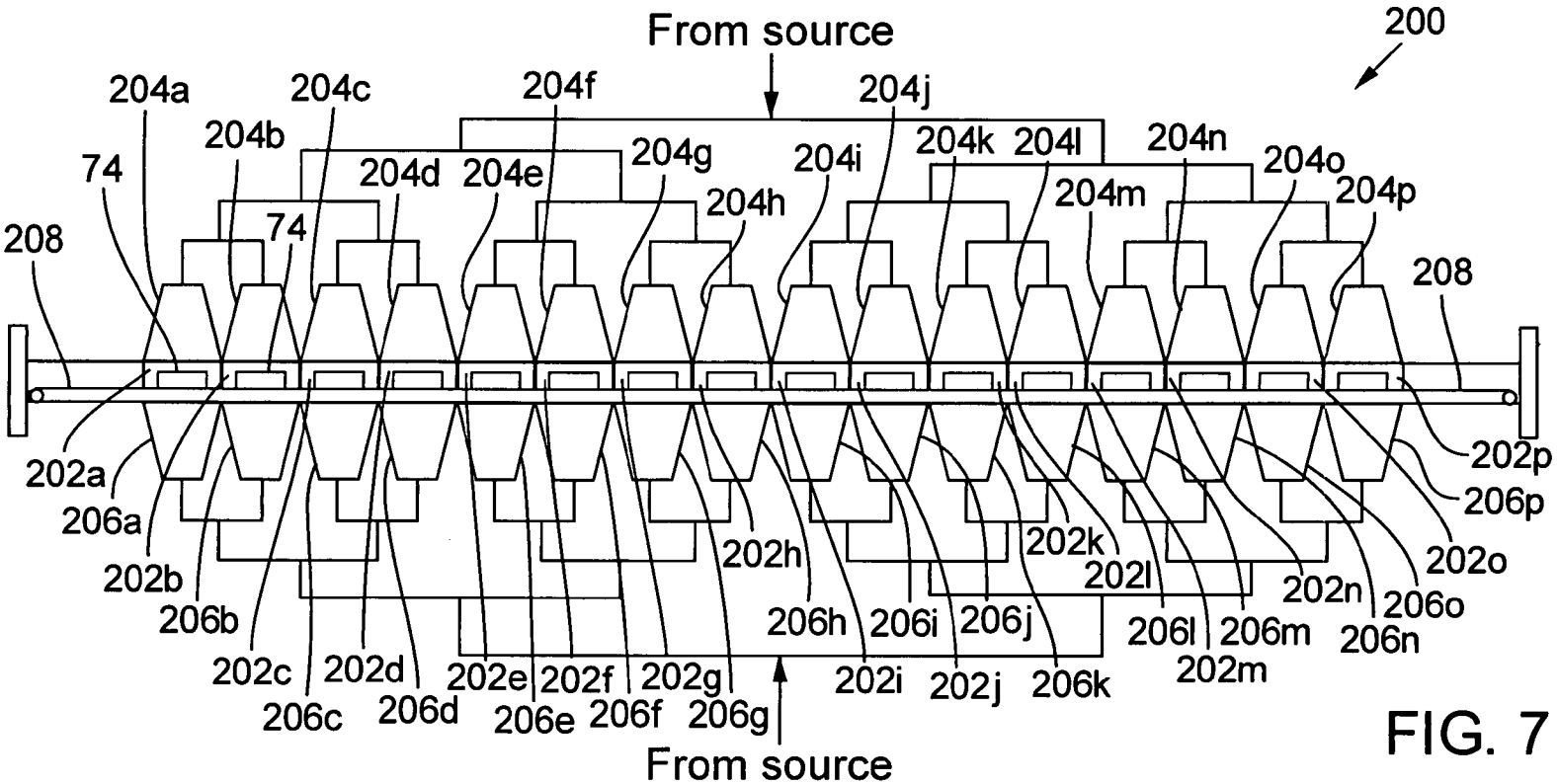
FIG. 7 is a schematic illustration of yet another embodiment of a microwave-heating apparatus.

The apparatus 100 can be expanded to include any number of microwave cavities with respective waveguides. FIG. 7, for example, shows an apparatus 200 comprising a plurality of microwave cavities 202*a*–202*p*, which have respective first waveguide applicators 204*a*–204*p* and respective second waveguide applicators 206*a*–206*p* positioned opposite the first waveguide applicators 204*a*–204*p*. The waveguide applicators 204*a*–204*p* and 206*a*–206*p* can receive microwaves from a single microwave source, or alternatively, each waveguide applicator or each pair of first and second waveguide applicators can have a respective, dedicated microwave source. A conveyor 208 extends through the cavities 202*a*–202*p* for conveying one or more foodstuffs 74 through the cavities 202*a*–202*p*.

Figure 8:
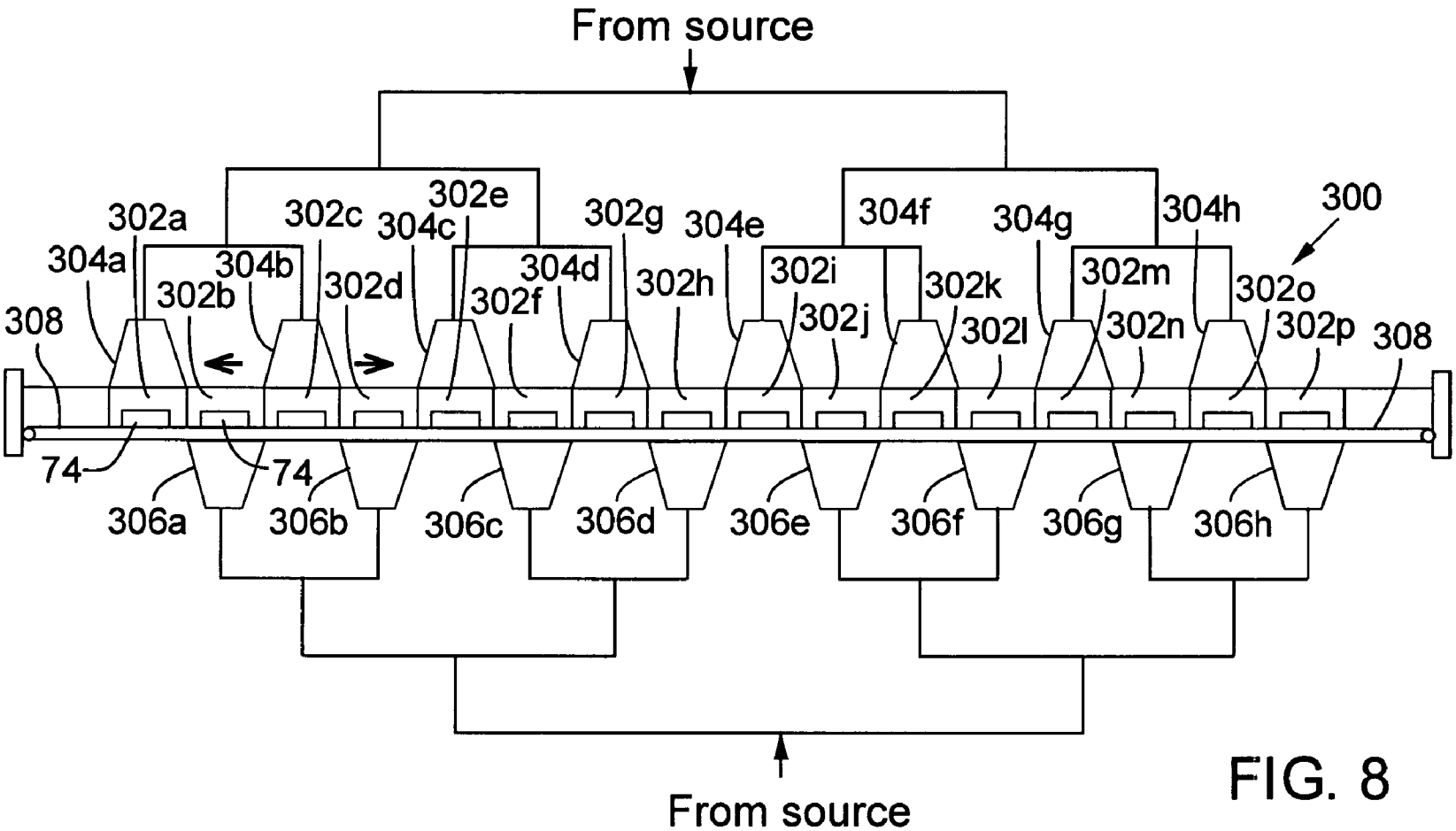
FIG. 8 is a schematic illustration of still another embodiment of a microwave-heating apparatus.

FIG. 8 shows an apparatus 300 comprising a plurality of microwave cavities 302*a*–302*p*. This embodiment is similar to the embodiment of FIG. 7, except that each cavity 302*a*–302*p* is alternately coupled to either one of a set of first waveguide applicators 304*a*–304*h* or one of a set of second waveguide applicators 306*a*–306*h*. The first waveguide applicators 304*a*–304*h* are positioned to direct microwaves through the upper walls of their respective cavities, and the second waveguide applicators 306*a*–306*h* are positioned to direct microwaves through the lower walls of their respective cavities. In this manner, the top and bottom surfaces of the foodstuffs 74 are alternately irradiated as the foodstuffs 74 move through the cavities 302*a*–302*p*. In the illustrated embodiment, a conveyor 308 extends through the cavities 302*a*–302*p* for automatically conveying one or more foodstuffs 74 through the cavities 302*a*–302*p*.

Figure 9:
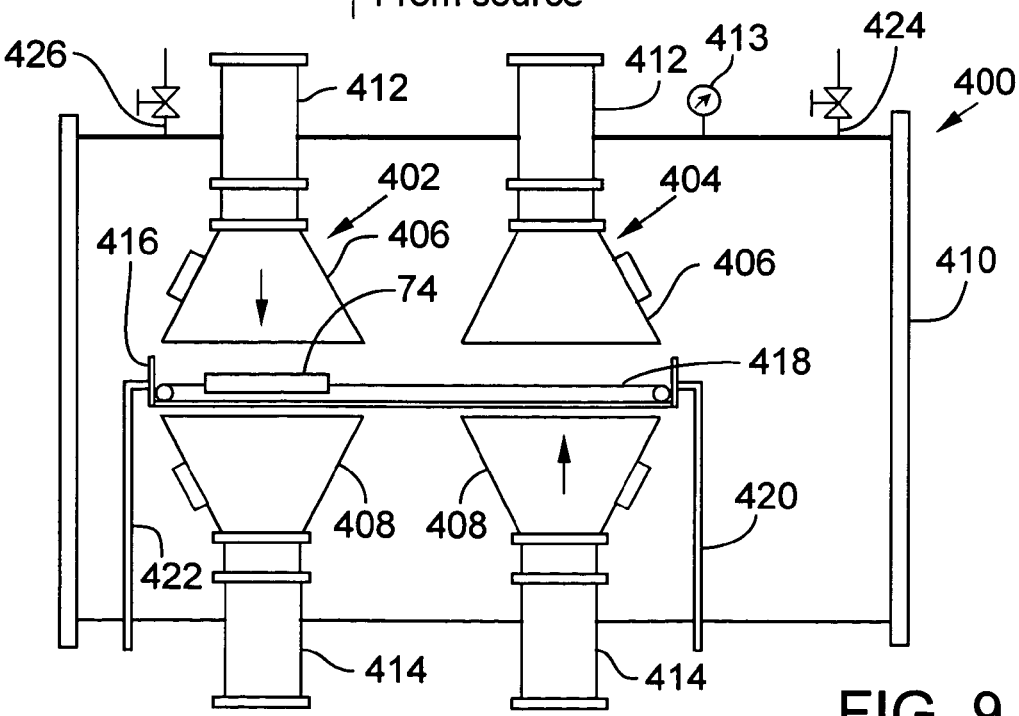
FIG. 9 is a schematic illustration of another embodiment of a microwave-heating apparatus.

Referring to FIG. 9, there is shown a microwave-heating apparatus 400 according to another embodiment. The apparatus 400 includes a first microwave unit 402 and a second microwave unit 404, each of which including a pair of opposed waveguide applicators 406, 408. Each microwave unit 402, 404 has a microwave "cavity" defined as the respective space between each pair of microwave applicators 406, 408.

A pressure vessel 410 forms an enclosure around the waveguide applicators 406, 408. The waveguide applicators 406, 408 are coupled to a microwave source (not shown) via the waveguides 412, 414, respectively, that extend through the walls of the pressure vessel 410. A container 416 extends between the waveguide applicators 406, 408 of the first and second microwave units 402, 404. A conveyor 418 can be positioned in the container 416 to move a foodstuff 74 between the microwave cavities defined between the microwave applicators 406, 408 during microwave heating. A fluid medium (e.g., water) can be introduced into the container 416 through an inlet-fluid conduit 420 to improve heating uniformity during microwave heating. The fluid medium can be discharged through an outlet-fluid conduit 422. The foodstuff 74 can be heated while immersed in a flow of the fluid medium or in a non-flowing pool of the fluid medium.

The illustrated pressure vessel 410 has a gas inlet 424 fluidly connectable to a source of a pressurized gas (e.g., compressed air) (not shown) for establishing a pressurized atmosphere (pressure indicated by a gauge 413) inside the pressure vessel 410. The container 416 is open to the atmosphere inside the pressure vessel 410 to prevent bursting of the packaging containing the foodstuff 74. After the foodstuff 74 is heated in the microwave apparatus 400, the pressurized gas can be released from the pressure vessel 410 through a gas outlet 426.

In another embodiment, the microwave apparatus 400 does not have a container 416, inlet-fluid conduit 420 or outlet-fluid conduit 422. Thus, in this alternative embodiment, the foodstuff 74 is not immersed in a fluid medium other than the gas used to pressurize the inside of the pressure vessel 410.

Figure 10:
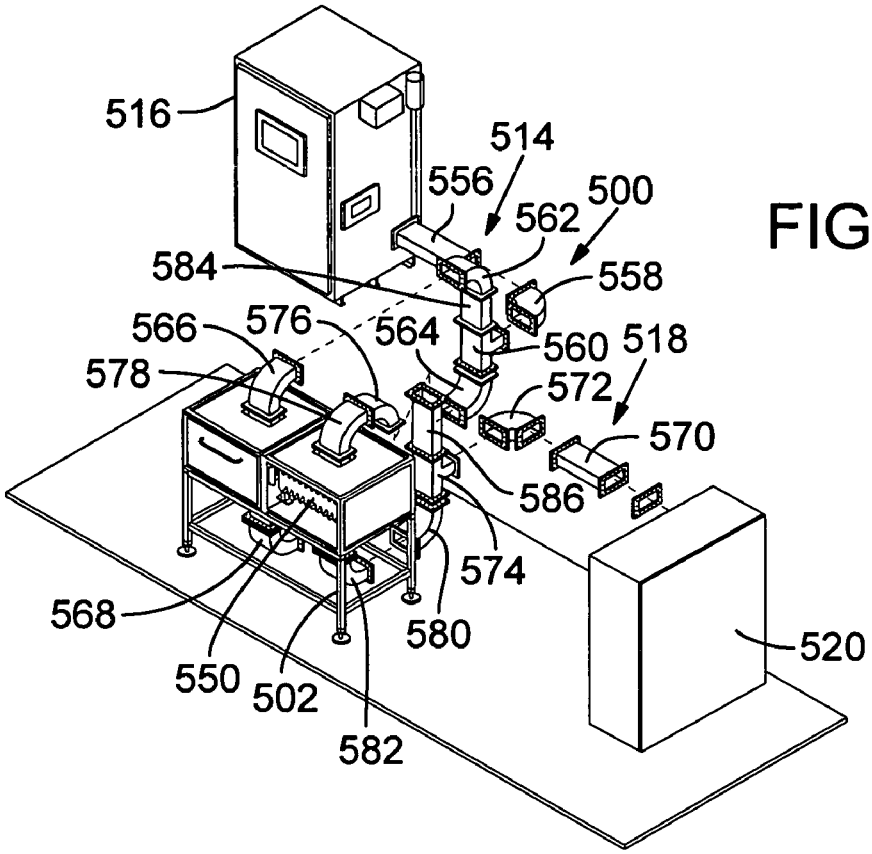
FIG. 10 is perspective view of a microwave-heating apparatus, according to another embodiment, having waveguide assemblies that are shown in an exploded or disassembled form.
Figure 11:
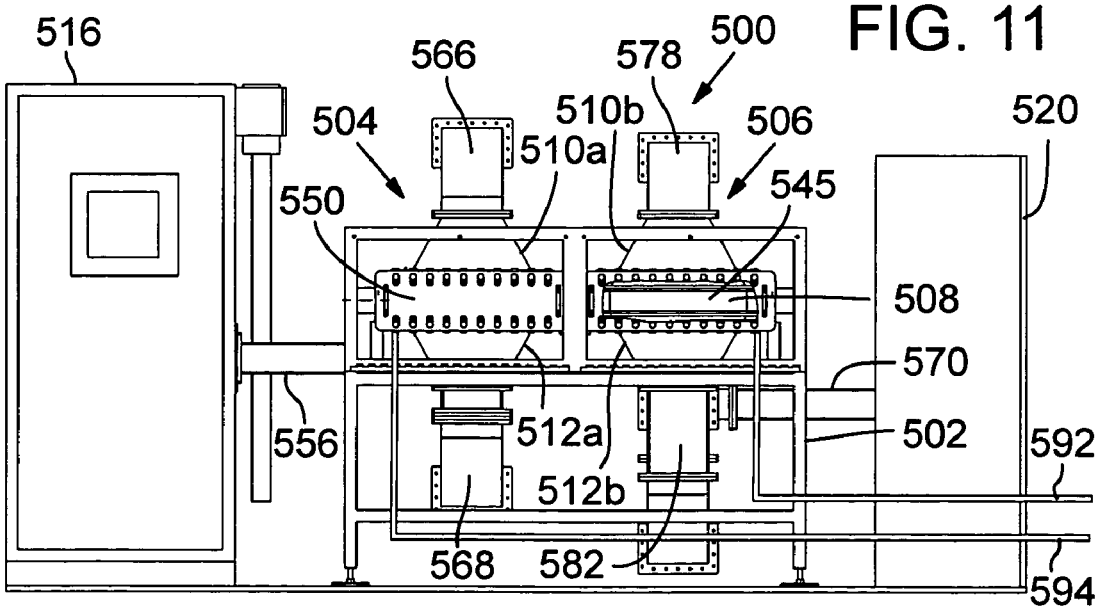
FIG. 11 is a front elevation view of the microwave-heating apparatus of FIG. 10.
Figure 12:
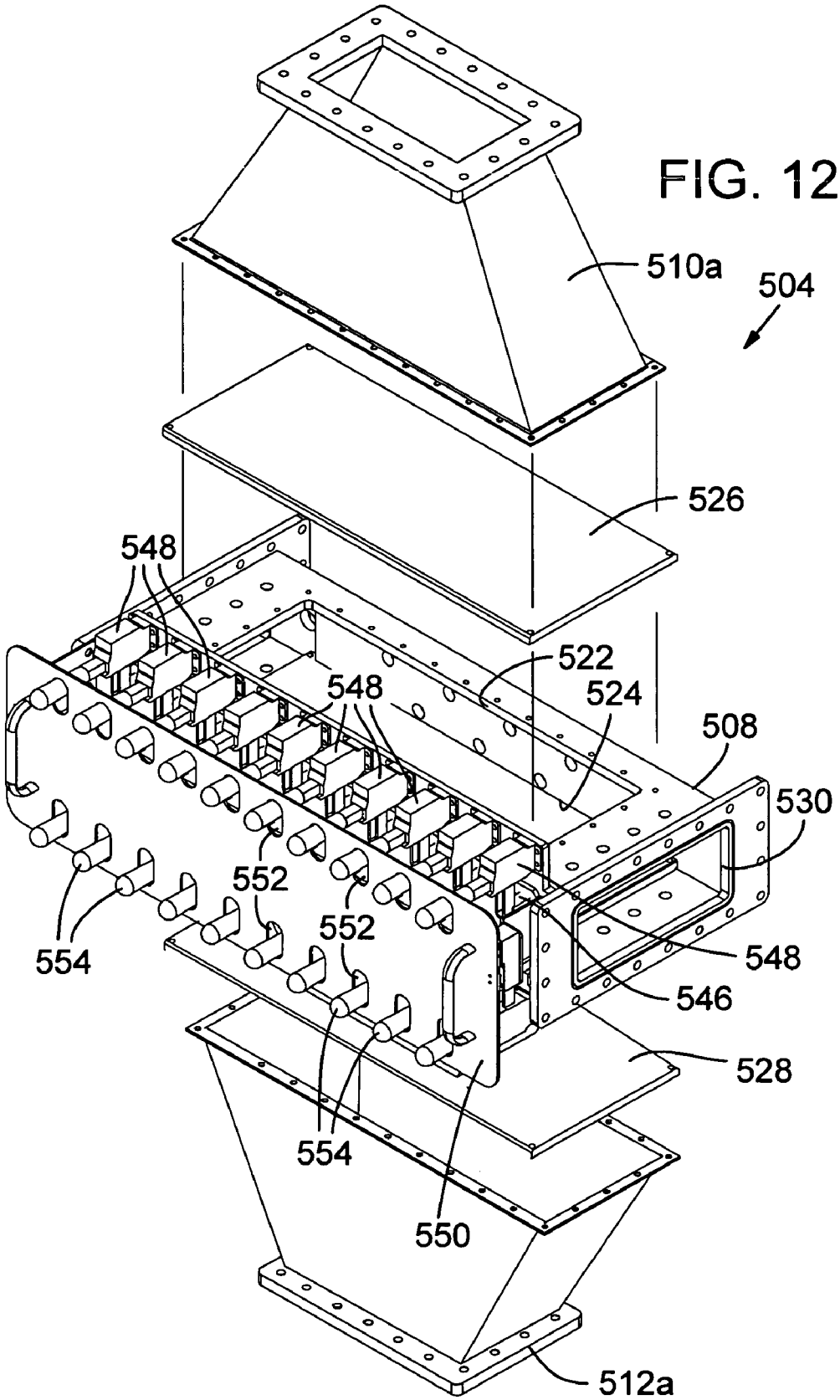
FIG. 12 is an enlarged, exploded, perspective view of one of the microwave cavities and corresponding microwave applicators of the microwave-heating apparatus of FIG. 10.

Referring now to FIGS. 10 and 11, there is shown a microwave-heating apparatus 500 according to another embodiment. The apparatus 500 in the illustrated embodiment comprises a support frame 502 that supports a first microwave unit 504 and a second microwave unit 506. As shown in FIG. 11, the first microwave unit 504 includes first and second microwave applicators 510*a* and 512*a*, and the second microwave unit 506 includes first and second microwave applicators 510*b* and 512*b*. A respective microwave cavity 508 is interposed between the microwave applicators 510*a*, 512*a* and between the microwave applicators 510*b*, 512*b* (as best shown in FIG. 12) (only the microwave cavity 508 of the second microwave unit 506 is shown in FIG. 11).

As best shown in FIG. 10, a first waveguide assembly 514 directs microwaves from a first microwave source 516 to the microwave applicators 510*a*, 512*a* of the first microwave unit 504. A second waveguide assembly 518 directs microwaves from a second microwave source 520 to the microwave applicators 510*b*, 512*b* of the second microwave unit 506.

In certain embodiments, the microwave sources 516, 520 generate microwaves within the 915 MHz ISM band or lower. Advantageously, microwaves within this frequency band have a longer wavelength and therefore can penetrate deeper into the foodstuff to be heated than can higher frequency microwaves (e.g., microwaves in the 2450 MHz ISM band). However, the embodiments described herein are not limited to operation within the 915 MHz band or lower. Accordingly, microwaves within any available frequency may be used.

The waveguide assemblies 514, 518 can have any of various configurations. As shown in FIG. 10, for example, the first waveguide assembly 514 includes a straight section 556, which extends from the microwave source 516 to an elbow 558. The elbow 558 is connected to a microwave splitter, such as the illustrated T-shaped waveguide section 560, which serves to direct the microwaves in two directions and introduces a 180° phase difference between microwaves exiting the co-linear outlets of the waveguide section 560. One outlet of the waveguide section 560 is connected to a straight waveguide section 584, which in turn is connected to an arcuate, or curved, waveguide section 562. The waveguide section 562 is connected to another arcuate waveguide section 566, which in turn is connected to the microwave applicator 510*a* (FIG. 11) of the first microwave unit 504. The other outlet of the waveguide section 560 is connected to an arcuate waveguide section 564 (FIG. 10), which in turn is connected to another arcuate waveguide section 568 (FIGS. 10 and 11). The waveguide section 568 is connected to the microwave applicator 512*a* (FIG. 11). Thus, one path for the microwaves is defined by the waveguide sections 584, 562, 566 and microwave applicator 510*a*, and another path for the microwaves is defined by the waveguide sections 564, 568 and microwave applicator 512*a*.

The second waveguide assembly 518 can have a construction that is similar to the construction of the first waveguide assembly 514. For example, as shown in FIG. 10, the second waveguide assembly 518 has a straight waveguide section 570, an elbow 572, and a T-shaped waveguide section 574. Extending between one outlet of the waveguide section 574 and the microwave applicator 510*b* are a straight waveguide section 586 and arcuate waveguide sections 576 and 578. Extending between the other outlet of the waveguide section 574 and the microwave applicator 512*b* are arcuate waveguide sections 580 and 582.

The length of the waveguide sections between the T-shaped waveguide sections 560, 574 and the respective cavities 508 can be selected to introduce a controlled phase difference between the microwaves propagating into a cavity in opposite directions. In one embodiment, for example, the overall length of the waveguide sections between the T-shaped section 560 and the upper wall of the respective cavity 508 is the same as the overall length of the waveguide sections between the T-shaped section 560 and the lower wall of the respective cavity 508. Similarly, the overall length of the waveguide sections between the T-shaped section 574 and the upper wall of the respective cavity 508 is the same as the overall length of the waveguide sections between the T-shaped section 574 and the lower wall of the respective cavity 508. Thus, in this embodiment, there will be a 180° phase difference between the microwaves propagating into each cavity 508 from opposing applicators (e.g., applicators 510*a* and 512*a*).

In other embodiments, however, the lengths of the waveguide sections extending from opposing outlets of waveguide sections 560 and 574 can be varied to vary the phase difference between the microwaves directed into a cavity from opposing applicators. For example, increasing or decreasing the overall length between the waveguide section 560 and one side of the respective cavity 508 by one-quarter of a wavelength will create a 90° phase difference between microwaves propagating into the cavity from opposing applicators 510*a* and 512*a*, increasing or decreasing the overall length between the waveguide section 560 and one side of the respective cavity 508 by one-half of a wavelength will create a 0° phase difference, and so on.

In one specific implementation, for example, microwave sources 516, 520 generate microwaves within the 915 MHz ISM band (which have a free-space wavelength of about 33 cm), and the waveguide sections have a transverse cross-section of about 24.8 cm×12.4 cm. In this implementation, the microwaves propagating through the waveguide sections have a wavelength of about 44 cm. To maintain the 180° phase difference between waves applied by the microwave applicators 510*a*, 512*a*, the waveguide sections 584, 562, and 566 are provided with an overall length that is equal to the overall length of the waveguide sections 564 and 568. As another example, a 90° phase difference can be established by providing the waveguide sections 584, 562, and 566 with an overall length that is greater than the overall length of the waveguide sections 564 and 568 by one-fourth the wavelength, or about 11 cm. It can be appreciated that any phase difference can be established by selecting the appropriate lengths for the waveguide sections between the waveguide section 560 and the microwave applicators 510*a*, 512*a*. In another implementation, the phase difference between the opposing waves in the cavity of the first microwave unit 504 can be different from the phase difference between the opposing waves in the cavity of the second microwave unit 506. In this manner, a foodstuff being conveyed through the cavities can be exposed to different modes or field configurations. As illustrated in the examples below, creating a phase difference, or phase shift, between microwaves propagating into a cavity from opposite directions can improve heating uniformity of foodstuffs.

The microwave applicators 510*a*, 510*b*, 512*a*, and 512*b* and/or cavities 508 can be configured to be easily removable and replaceable with differently configured microwave applicators and/or cavities, such as a microwave applicator having different flare angles $\theta_x$, $\theta_y$ or a differently sized cavity. In this manner, certain waveguide, applicator, and cavity configurations can be selected to achieve a desired heating effect for a particular foodstuff. In addition, the waveguide, applicator, and cavity configurations can be selected so that a foodstuff being conveyed or otherwise moved through the cavities are exposed to a different mode or field configuration in each cavity.

In one implementation, computer simulations are performed (described below) on a proposed cavity configuration to predict the field distribution in the cavity and the absorbed-power deposition profile in the foodstuff to be heated. In addition, computer simulations can be performed to determine the maximum allowable dimensions for a cavity that will still enable the cavity to operate as a single-mode cavity. Based on the computer simulations, the dimensions of the cavity are selected to achieve the desired heating effect for that foodstuff. If a differently sized foodstuff or a foodstuff having a different permittivity is to be pasteurized or sterilized in the system, then additional computer simulations can be performed to determine the optimum cavity dimensions for that foodstuff.

In one proposed use, a food-processing facility can stock multiple cavities, each one being useable in the same microwave system and optimized for pasteurizing or sterilizing a particular foodstuff. Thus, a microwave system that is presently configured for use with one type of foodstuff (e.g., macaroni and cheese) can be converted for use with another type of foodstuff (e.g., pizza) by removing the presently-installed cavities and installing the cavities optimized for the new foodstuff.

In addition, as demonstrated in the examples below, the absorbed-power distribution along the depth of the foodstuff to be heated can be varied by varying the phase difference between the opposing waves. Computer simulations (described below) can be performed for a particular foodstuff to determine the phase difference that will optimize heating uniformity of the foodstuff. In particular embodiments, the waveguide sections of the first and second waveguide assemblies 514 and 518 are configured to be easily removable and replaceable with other waveguide sections so that either of microwave units 504 or 506 can be operated with a selected phase difference to optimize heating for a particular foodstuff. In alternative embodiments, other suitable techniques can be employed to vary the phase difference, such as through dielectric loading of a waveguide.

In the illustrated embodiment, the cavities 508 of microwave units 504 and 506 are in communication with each other so that foodstuffs can be conveyed or otherwise moved between the cavities 508 during microwave heating. The cavities 508 desirably are fluid-tight up to a specified pressure (e.g., 30 psig) to contain a pressurized fluid medium (e.g., water) therein for preventing bursting of the foodstuffs and for improving heating uniformity of the foodstuffs, as described above.

As shown in FIG. 11, the apparatus 500 can have an inlet-fluid conduit 592 for introducing the fluid medium into the cavities 508 and an outlet-fluid conduit 594 for removing the fluid medium. In certain embodiments, the fluid medium is circulated through the cavities 508 by a closed-loop re-circulating system, in which the inlet-fluid conduit 592 is fluidly connected to the outlet of a re-circulating pump and the outlet-fluid conduit 594 is fluidly connected to the inlet of the re-circulating pump. The re-circulating system also can include a heating device, such as a heat exchanger, for pre-heating the fluid medium flowing into the cavities 508 to a desired temperature (e.g., the sterilization or pasteurization temperature of the foodstuffs to be heated).

FIG. 12 shows an enlarged, exploded, perspective view of a portion of the first microwave unit 504, according to one embodiment. In the illustrated embodiment, the second microwave unit 506 is identical in construction to the first microwave unit 504. Hence, the following description of the first microwave unit 504 also applies to the second microwave unit 506. As shown in FIG. 12, the top and bottom walls of the cavity 508 are formed with respective apertures 522 and 524, respectively, to allow microwaves from applicators 510*a* and 512*a*, respectively, to enter into the cavity 508. Desirably, microwave-transparent windows 526 and 528 cover the apertures 522, 524, respectively, in the top and bottom of the cavity 508. The windows 526, 528 can be made from any suitable microwave-transparent material. In particular embodiments, the windows 526, 528 are made of Plexiglas® or Ultem® and have a thickness of at least 12.5 mm. In alternative embodiments, the apertures 522, 524 are not covered by windows 526, 528, in which case foodstuffs are heated in an atmosphere of air inside the cavities 508.

Figure 13:
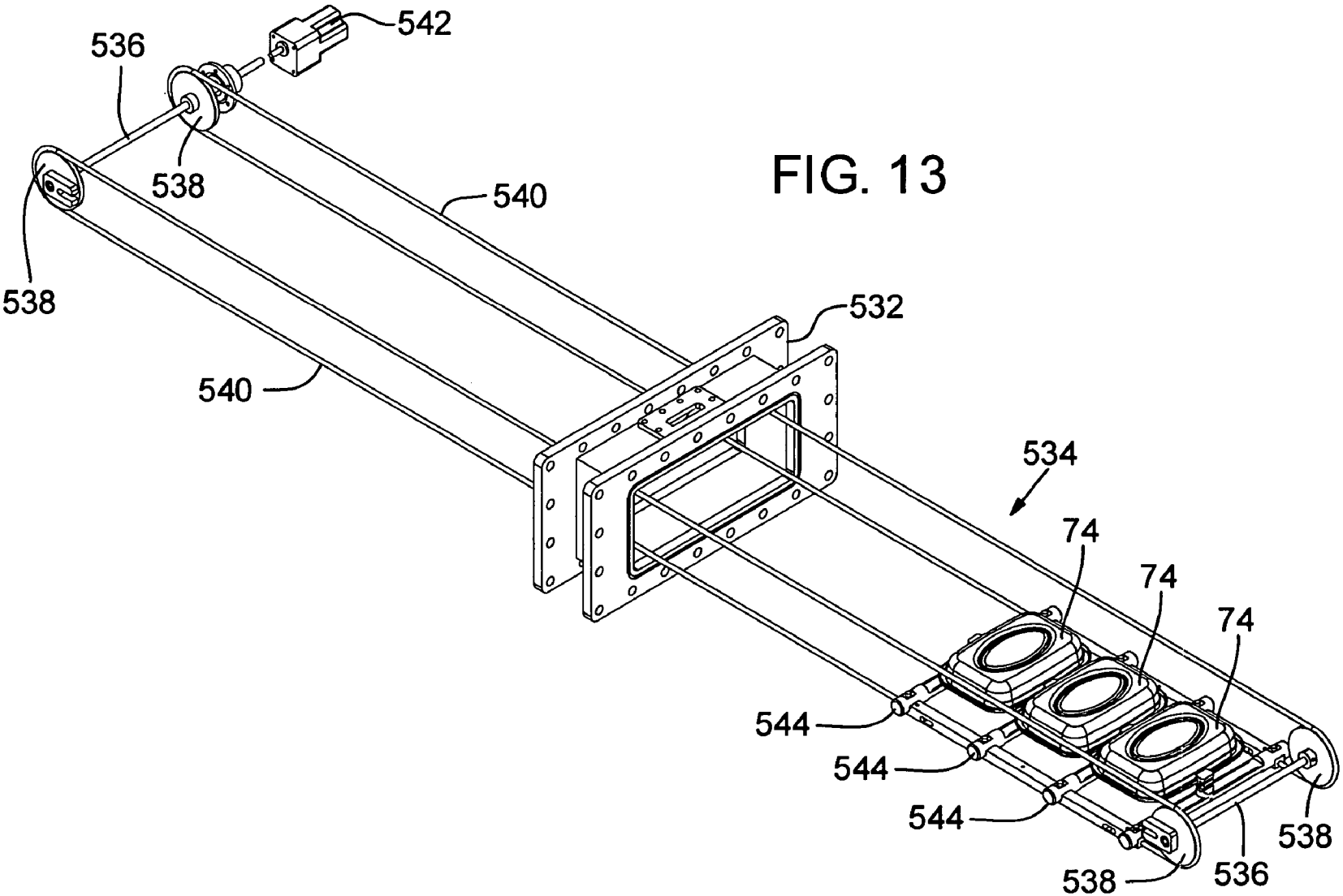
FIG. 13 is an enlarged, perspective view of a conveyor system, according to one embodiment, for use in a microwave-heating apparatus.

One side wall of the cavity 508 is formed with an opening 530. An adjacent side wall of the cavity 508 of the second microwave unit 506 (FIGS. 10 and 11) is also formed with an opening (not shown) so that foodstuffs can pass between the cavities 508 of the first and second microwave units 504, 506, respectively. The adjacent sides of the cavities 508 can be coupled to each other with a transition section 532, shown in FIG. 13, positioned between the cavities 508.

In particular embodiments, a conveyor system 534 (FIG. 13) automatically moves foodstuffs 74 between the cavities 508. The illustrated conveyor 534 includes a respective axle 536 rotatably mounted in each cavity 508 and an electric motor 542 or other suitable drive mechanism coupled to one of the axles 536. Respective pulleys 538 are mounted to the opposite ends of each axle 536. Belts 540 are reeved around the pulleys 538 on the opposing axles 536 to transfer rotational movement between axles 536. Foodstuffs 74 are supported on transverse members 544 extending between the belts 540. As can be appreciated from FIG. 13, actuation of the drive motor 542 cause the axles to rotate, thereby moving the foodstuffs 74 longitudinally through the cavities 508. The drive motor 542 desirably is bi-directional to allow the foodstuffs 74 to be moved back and forth between the cavities 508 as desired.

As shown in FIG. 11, each cavity 508 can be formed with an opening 545 (only one of which is shown in FIG. 11) in a front wall thereof to permit insertion and removal of foodstuffs 74. As best shown in FIG. 12, a removable door 546 covers the opening 545 in each cavity 508 and is held securely in place by upper and lower rows of clamps 548 or analogous fasteners. A removable plate 550 is formed with upper and lower rows of apertures 552 dimensioned to receive respective handles 554 of the clamps 548. The plate 550, when placed over the handles 554 in the manner shown in FIG. 12, ensures that clamps 548 are retained in their clamped position to hold the door 546 securely in place during microwave heating.

EXAMPLES

Example 1

Computer Simulation of a Rectangular Waveguide and Cavity

Figure 14A:
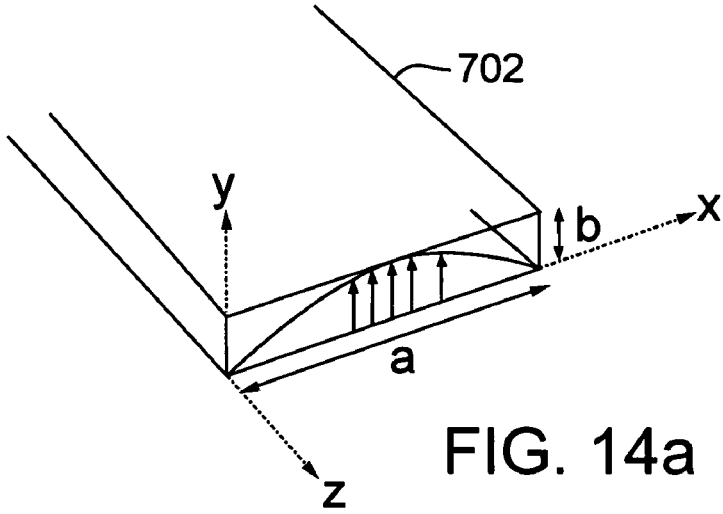
FIG. 14*a* is a schematic illustration showing the field distribution and wave-propagation characteristics of the fundamental mode of a rectangular waveguide.

In this example, computer modeling is used to demonstrate the effect of changing the dimensions of a rectangular microwave cavity on the field-distribution and wave-propagation characteristics in the cavity. The computer simulations were performed using Quick-Wave software, available from QWED of Warsaw, Poland, on a Pentium PC with an 850-MHz processor and 256-MB RAM under a Windows NT 4.0 operating system. Referring first to FIG. 14*a*, there is shown a conventional rectangular waveguide 702 having a transverse cross-sectional profile defined by a length a in the x direction and a width b in the y direction, with the x and y directions being indicated in FIG. 14*a*. In the computer simulations of this example, the value of a is 247.65 mm and the value of b is 123.825 mm, and the frequency of the microwaves is 915 MHz.

The lowest-order propagating mode for the waveguide 702 is the $TE_{10}$ mode (m=1, n=0), which is referred to as the "dominant" or "fundamental mode" of the waveguide. As shown in FIG. 14*a*, the polarization of the electric field in the fundamental mode is along the y axis and is distributed as a half sine wave over the aperture of the waveguide along the x axis.

Figure 14B:
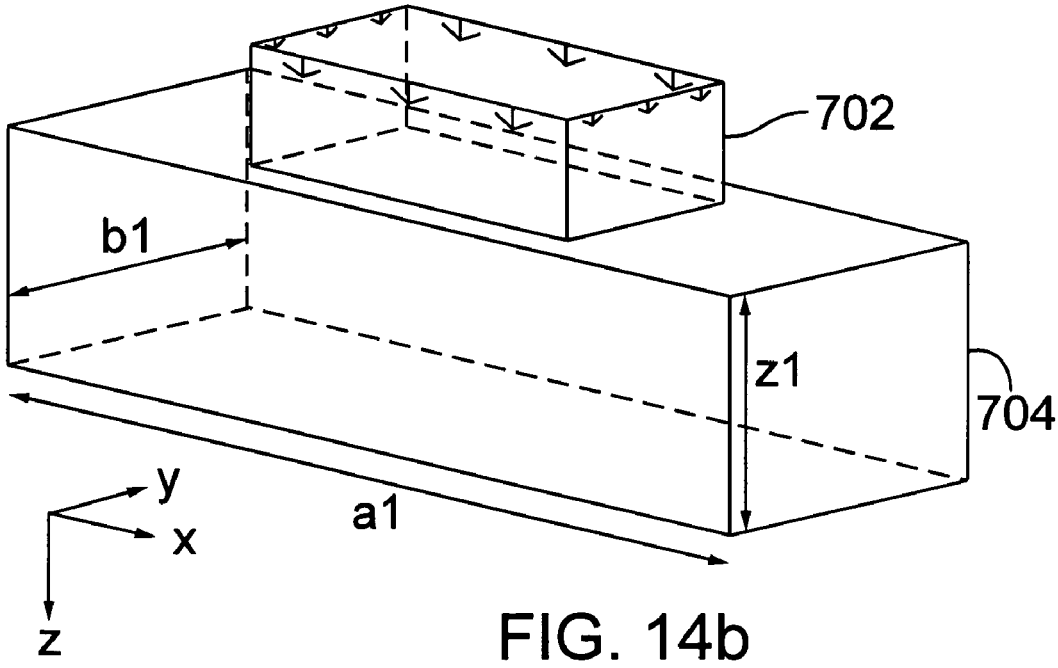
FIG. 14*b* is a schematic illustration of a rectangular waveguide coupled to a rectangular microwave cavity having a greater cross-sectional area than the waveguide.

FIG. 14*b* depicts a waveguide assembly comprising the waveguide 702 coupled to a larger rectangular cavity 704. The cavity 704 has a length a1 in the x direction, a width b1 in the y direction, and a depth z1 in the z direction, with the x, y, and z directions being indicated in FIG. 14*b* (dimensions a, a1, b, and b1 are depicted for a rectangular waveguide and a horn-shaped applicator in FIGS. 3–5).

For the waveguide 704, the dominant or fundamental mode is the TE10 mode (m=1, n=0). To simulate the presence of the TE10 mode, the cavity 704 was excited through the waveguide 702 (FIG. 14*b*). The cavity 702 and waveguide 704 were incremented into cubic cells using the standard finite-difference time-domain (FDTD) "rule of thumb," which suggests the use of at least ten cells per wavelength in a medium with permittivity $\epsilon$:

$$\Delta cell \leq \frac{c}{10f\sqrt{\varepsilon}}, \tag{1}$$

where c is the velocity of light in a vacuum, f is the frequency of the wave, and $\epsilon$ is the permittivity of the medium in the cavity and waveguide. In accordance with Equation (1), the cell sizes for the cavity and waveguide in an atmosphere of air should be less than 33 mm at 915 MHz. For the present example, the cell sizes were selected to be 10 mm in all three dimensions.

From a knowledge of the transverse electromagnetic field at the aperture of the first waveguide 702, it is possible to predict via computer simulations various characteristics of the cavity 704. One of such characteristics is the distribution of the dominant electric field (which is the $E_y$ component in this example) in the cavity 704. The mode distributions were simulated as a function of the x, y, and z dimensions of the cavity 704. The findings from these simulations are discussed below.

Figure 15A:
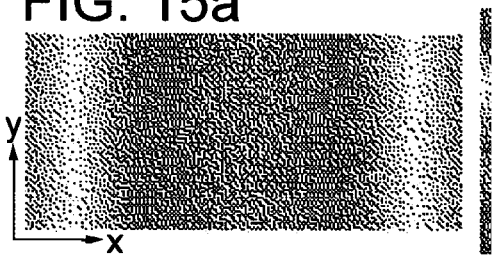
FIGS. 15*a*–15*f* illustrate computer-simulated field-distribution characteristics in two different planes for various lengths of the cavity of FIG. 14*b*.
Figure 15B:
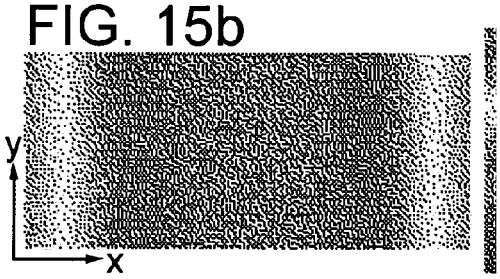
Figure 15C:
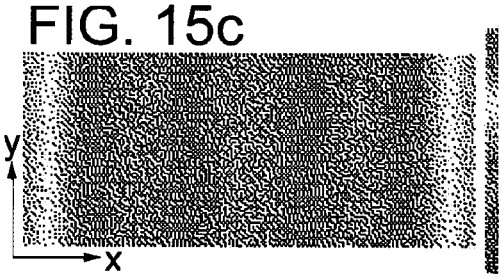
Figure 15D:
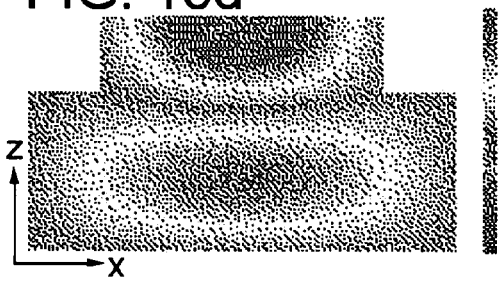
Figure 15E:
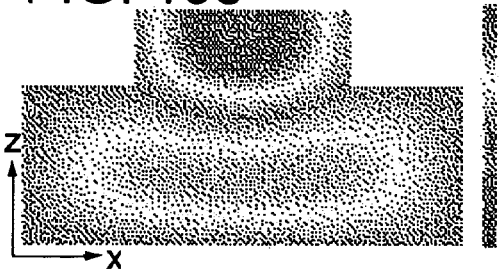
Figure 15F:
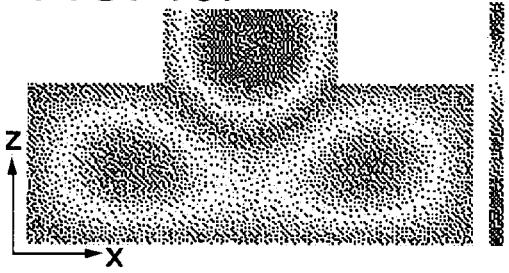

In one series of computer simulations (shown in FIGS. 15*a*–15*f*), the width b1 of the cavity 704 is equal to the width b of the waveguide 702 (123.825 mm), the depth z1 is 200 mm, and the length a1 is varied. FIGS. 15*a*–15*c* show the distribution of the dominant electric field component $E_y$ (which is more than eight times stronger than the electric components $E_x$ and $E_y$) over the x-y plane at the middle of the depth of the cavity 704 (i.e., at the middle of z1) when the length a1 is equal to 1.5a, 2.0a, and 2.5a, respectively. FIGS. 15*a*–15*c* demonstrate that, for small a1 values, energy is distributed mainly around the center of the x-y plane in a single mode. FIGS. 15*d*-15*f* show the distribution of the $E_y$ component over the x-z plane at the middle of the width of the cavity and waveguide (i.e., at the middle of b1) when the length a1 is equal to 1.5a, 2.0a, and 2.5a, respectively. As shown in FIGS. 15*d*–15*f*, the spread area of the single-mode energy increases as the length a1 increases, and the electric field splits into two modes in the x direction when a1 is greater than 2.0a. Therefore, in the present example, the length a1 of the cavity 704 should not be greater than twice the length of the waveguide 702 to operate the cavity 704 with a single-lobed heating mode. The field configuration observed in FIGS. 15*b* and 15*e* is suitable for heating foodstuffs having relatively large packages, such as pizzas and tray foodstuffs.

Figure 16A:
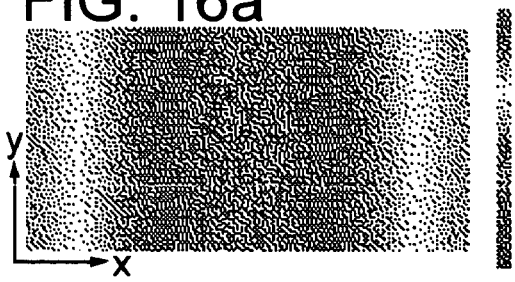
FIGS. 16*a*–16*f* illustrate computer-simulated field-distribution characteristics in two different planes for various widths of the cavity of FIG. 14*b*.
Figure 16B:
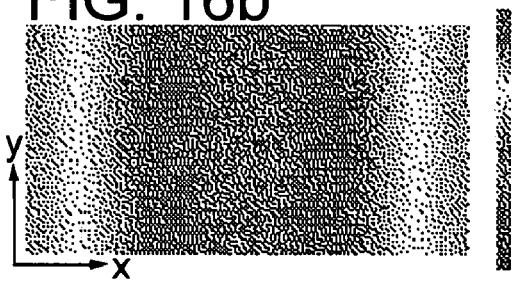
Figure 16C:
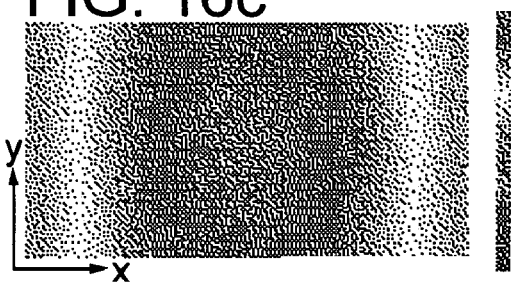
Figure 16D:
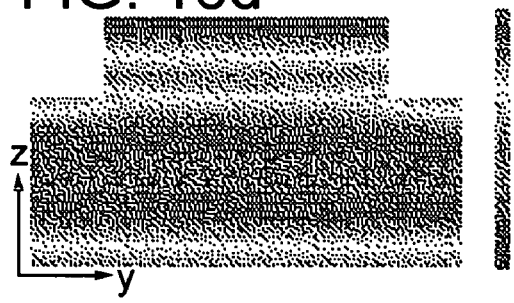
Figure 16E:
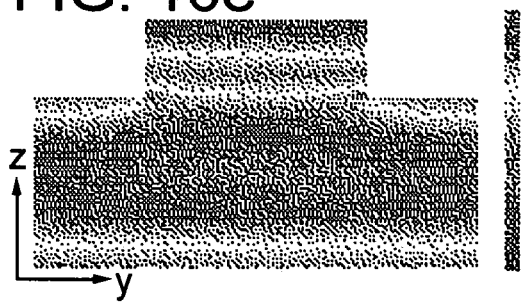
Figure 16F:
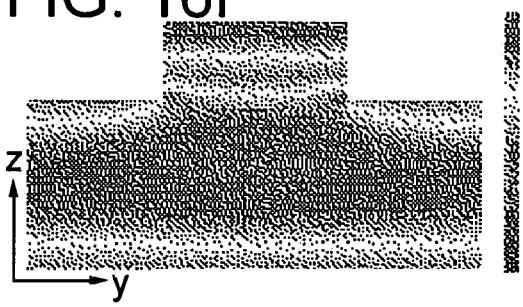

In another series of computer simulations (shown in FIGS. 16*a*–16*f*), the length a1 of the cavity 704 is equal to the length a of the waveguide 702 (247.65 mm), the depth z1 is 200 mm, and the width b1 is varied. FIGS. 16*a*–16*c* show the distribution of the $E_y$ component across the x-y plane at the middle of z1 when the width b1 is equal to 1.5b, 2.0b, and 2.5b, respectively. FIGS. 16*d*–16*f* show the distribution of the $E_y$ component across the y-z plane at the middle of a1 when the width b1 is equal to 1.5b, 2.0b, and 2.5b, respectively. As shown in FIGS. 16*a*–16*c*, as the width b1 of the cavity 704 increases, the energy becomes focused as a beam at the center of the cavity in the x-y plane. The y-z plane characteristics, shown in FIGS. 16*d*–16*f*, also display this phenomenon. This type of energy distribution is suitable for applications requiring focused microwave energy for heating, such as when heating foodstuffs having a relatively smaller cross-section and/or a greater depth.

Figure 17A:
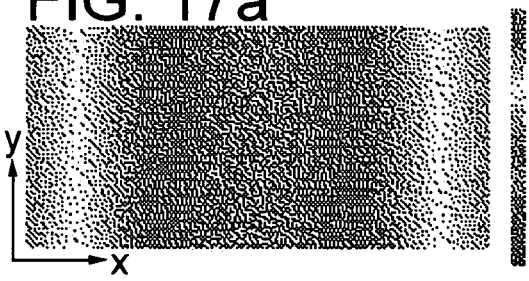
FIGS. 17*a*–17*d* illustrate computer-simulated field-distribution characteristics for various lengths and widths of the cavity of FIG. 14*b*.
Figure 17B:
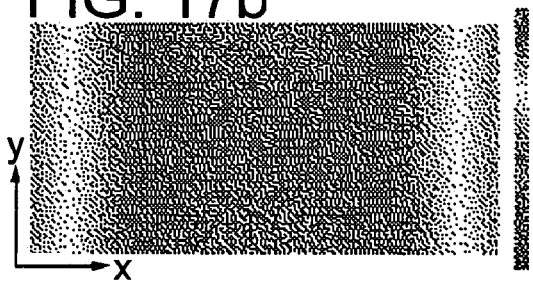
Figure 17C:
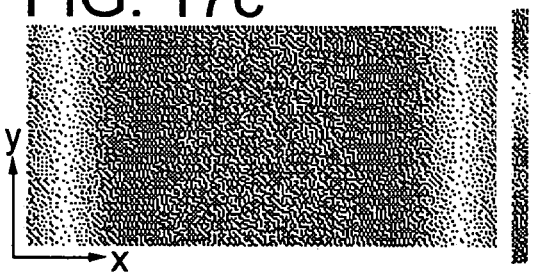
Figure 17D:
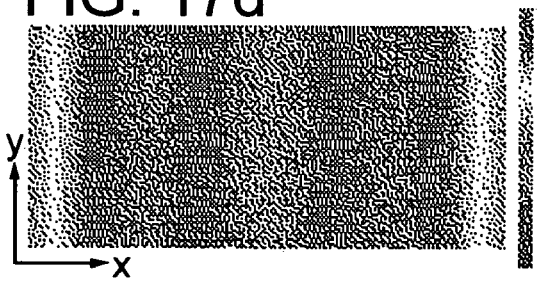

FIGS. 17*a*–17*d* illustrates the combined effect of varying the length and width of the cavity 704 on the mode distribution across the x-y plane at the middle of z1 (for a depth z1 of 200 mm, a waveguide length a of 247.65 mm, and a waveguide width b of 123.825 mm). Specifically, FIG. 17*a* shows the distribution of the $E_y$ component across the x-y plane at the middle of z1 when the length a1 is equal to 1.5a and the width b1 is equal to 1.5b; FIG. 17*b* shows the distribution of the $E_y$ component across the x-y plane at the middle of z1 when the length a1 is equal to 2.0a and the width b1 is equal to 2.0b; FIG. 17*c* shows the distribution of the $E_y$ component across the x-y plane at the middle of z1 when the length a1 is equal to 2.0a and the width b1 is equal to 1.5b; and FIG. 17*d* shows the distribution of the $E_y$ component across the x-y plane at the middle of z1 when the length a1 is equal to 2.5a and the width b1 is equal to 1.5b.

As noted above, and as shown in FIG. 14*a*, the polarization of the fundamental mode is along the y axis and is distributed as a half-sine-wave over the aperture of the waveguide 702 along the x axis. As the length of the cavity 704 increases and the width remains constant, the half-sine-wave distribution of the wave entering the cavity 704 elongates along the x axis, as illustrated in FIGS. 15*a*–15*f* and FIG. 17*c*. On the other hand, as the width of the cavity 704 increases and the length remains constant, the electric field lines move towards the center of the cavity 704, thereby resulting in a focused energy distribution, as shown in FIGS. 16*a*–16*f* and FIG. 17*a*.

As both the length and width change, the wavefront emanating from the aperture of the waveguide 702 experiences a radial spread in the x-y plane, and a phase component is introduced between wavefronts at different axial locations along the z axis of the cavity 704. When this phase component becomes sufficiently large, the field distribution in the cavity 704 splits into two directions and its reflection from respective walls of the cavity forms two lobes. For example, FIG. 17*b* shows a phase component between wavefronts resulting from a change in the width b1 of the cavity 704. FIG. 17*d* shows a phase component between wavefronts resulting from a change in the length a1 of the cavity 704.

FIGS. 18*a*–18*f* illustrate the effect of varying the depth of the cavity 704 on the field distribution of the $E_y$ component over the x-y plane at the middle of the depth z1 of the cavity 704. In the simulations shown in FIGS. 18*a*–18*c*, the length a1 of the cavity 704 is 2.0a, the width b1 is 1.5b, and the depth is 200 mm, 150 mm, and 100 mm, respectively. In the simulations shown in FIGS. 18*d*–18*f*, the length a1 of the cavity 704 is 2.5a, the width b1 is 1.5b, and the depth is 200 mm, 150 mm, and 100 mm, respectively.

Figure 18A:
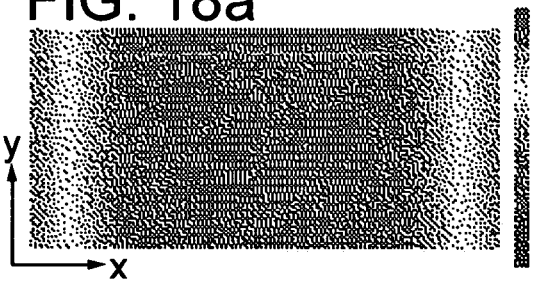
FIGS. 18*a*–18*f* illustrate computer-simulated field-distribution characteristics for various lengths and depths of the cavity of FIG. 14*b*.
Figure 18D:
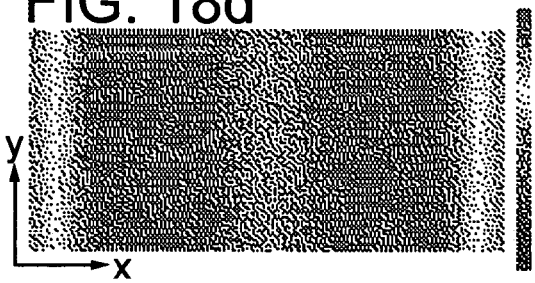

As the depth of the cavity 704 increases, a large phase component is introduced between the two wavefronts, causing the field distribution to split into two lobes, as shown in FIG. 18*d*. However, as cavity depth decreases, due to very small changes in phase components, the field distribution generally becomes focused around the central region of the cavity, as shown in FIGS. 18*b*, 18*c*, 18*e*, and 18*f*.

Based on the foregoing simulations, one can easily tailor the dimensions of a cavity to achieve an energy/mode distribution required for a particular application. These simulations also demonstrate that a microwave cavity can operate with a multitude of different field configurations or distributions as a single-mode cavity by varying the x, y, and z dimensions of the cavity.

Example 2

Figure 19:
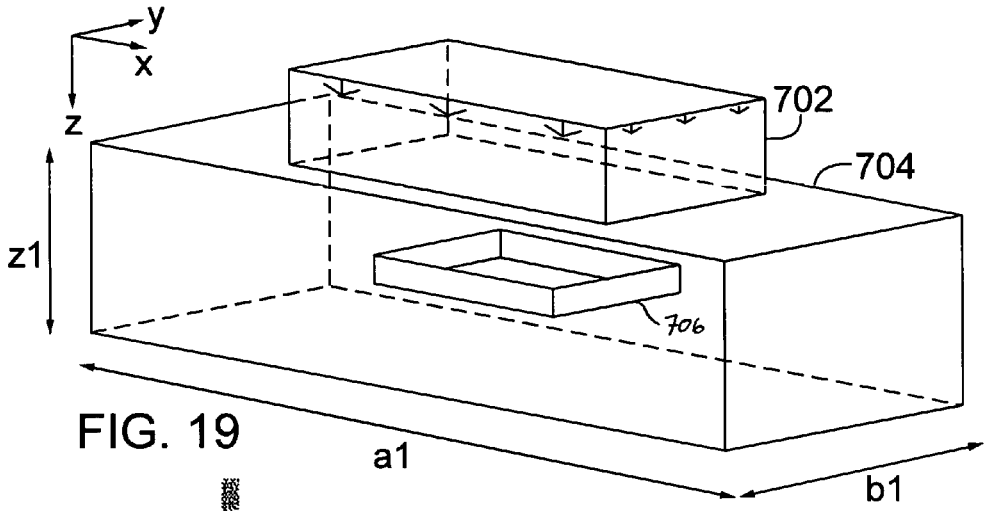
FIG. 19 is a schematic illustration similar to FIG. 14*b*, showing a load placed in the cavity.

Computer Simulation of a Rectangular Waveguide and Cavity with Load in Cavity In this example, computer modeling was used to evaluate the performance of the assembly of FIG. 14*a* as a load 706 (e.g., a food package) is heated in the cavity 704 (FIG. 19). As in the previous example, the waveguide 702 had a length a of 247.65 mm and a width b of 123.825 mm. The cavity 704 in this example had a length a1 equal to 2.0a, a width b1 equal to 1.5b, and a depth z1 of 100 mm. The dimensions of the load 706 were 140 mm in the x direction, 100 mm in the y direction, and 30 mm in the z direction, and the complex permittivity value, $\epsilon^*=\epsilon'-j\epsilon''$, of the load was 47.45−j 38.55 as a model of whey gel. All the simulations were performed at 915 MHZ.

The power-deposition profile over top surface of the load 706 was calculated under two conditions. In the first case, the load 706 was positioned in the central region of the cavity 704 and exposed to air. In the second case, the load 706 was immersed in water having a complex permittivity value, $\epsilon^*=\epsilon'-j\epsilon''$, of 71.207−j 16.757. Following the criterion of equation (1) above, the cell sizes of the cavity were 10 $mm^3$ in the air-filled cavity and 3 $mm^3$ in the water-filled cavity.

Figure 18B:
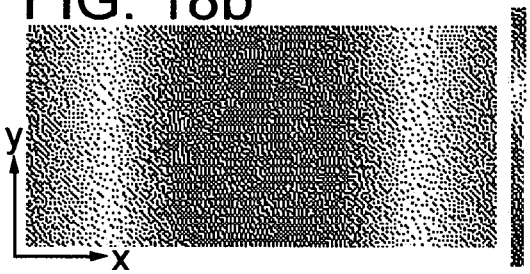
Figure 18E:
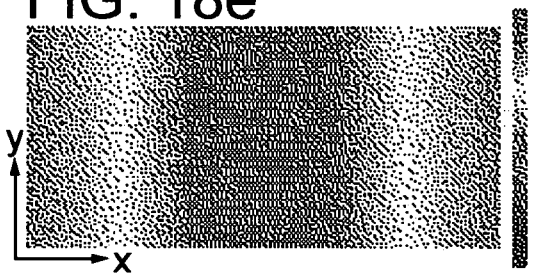
Figure 18C:
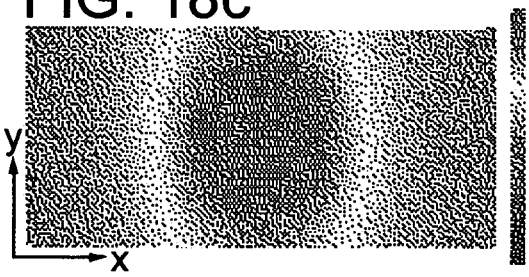
Figure 18F:
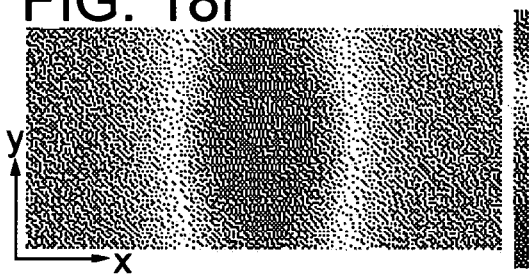
Figure 20A:
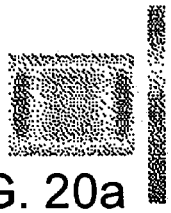
FIGS. 20*a* and 20*b* illustrate computer-simulated power-deposition profiles over the top surface of the load shown in FIG. 19.
Figure 20B:
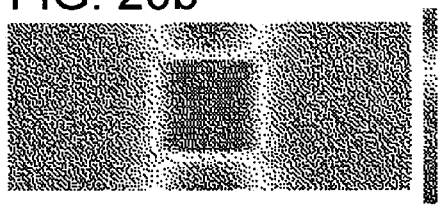

FIGS. 20*a* and 20*b* show the power-deposition pattern over the top surface (in an x-y plane) of the load 706 in air and water, respectively. As shown in FIG. 20*a*, when the load is heated in air, the power deposition at the edges of the load are much larger than in the middle, resulting in a very uneven power-deposition pattern. In addition, the electric field in the load split into two different lobes, despite the fact that only a single lobe was generated in the empty cavity of the same dimensions, as shown in FIG. 18*c*. This difference is caused by the reflection and refraction of the waves at the interfaces between the load and the surrounding air, as well as discontinuity of the electric- and magnetic-field components at the food-air boundaries of the food package.

As shown in FIG. 20*b*, whenever the load was immersed in water, the power-deposition profile over the load resembled a single lobe. This increase in uniformity is a consequence of the water and the load acting as a substantially homogeneous load.

Example 3

Experimental Results of Rectangular Waveguide and Cavity

In this example, experiments were performed to verify the results of the computer simulations of Examples 1 and 2, above. In these experiments, loads were heated in rectangular microwave cavities constructed from aluminum plates. The cavities were coupled to a 20 kW, 915 MHz microwave power source manufactured by The Ferrite Company, Inc. of Hudson, N.H., with a rectangular waveguide having an a dimension of 247.65 mm and a b dimension of 123.825 mm (FIG. 14*a*). Results were obtained for cavities having dimensions of a1=2.0a, b1=1.5b, and z1=100 mm and a1=2.0a, b1=1.5b, and z1=150 mm. The reflection of the power was measured with a directional coupler in the source and a HP power meter. A power level of 6 KW was delivered to the load to achieve a heating time of about 30 seconds to 2 minutes to cause a 30° C. to 64° C. rise in temperature while minimizing the influence of heat conduction. The absorbed microwave power-distribution pattern across the load surface was measured using a ThermaCAM® SC-3000 infrared camera, available from FLIR Systems, Inc.

Figure 21A:
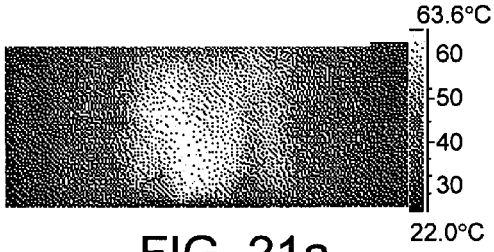
FIGS. 21*a* and 21*b* show experimental power-deposition profiles over a wet piece of paper placed that was heated in the middle of a rectangular cavity having a depth of 150 mm (FIG. 21*a*) and a depth of 100 mm (FIG. 21*b*).
Figure 21B:
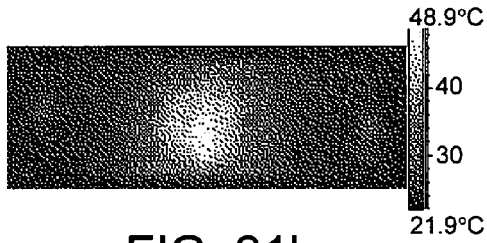

To verify the field-distribution characteristics in the empty cavities, it was necessary to measure the y-polarized dominant electric-field component (the $E_y$ component) strength, which is more than eight times stronger than the other electric-field components. To simplify this measurement, a thin, wet piece of paper was placed in an x-y plane in the middle of the cavities as an indirect way to measure the intensity of the electric-field pattern in an empty cavity. Microwave power was delivered to the cavities for 30 seconds, and the piece of paper was immediately taken out from the cavities for infrared imaging. FIG. 21*a* shows the infrared image of a piece of paper heated in the cavity, having a depth of 150 mm. FIG. 21*b* shows the infrared image of a piece of paper heated in the cavity having a depth of 100 mm. The patterns shown in FIGS. 21*a* and 21*b* are similar to the intensity of the simulated electric field of the $E_y$ component, as shown in FIGS. 18*b* and 18*c*, respectively, for the respective cavity depth. From the images of FIGS. 21*a* and 21*b*, it can be seen that power or field lines are concentrated in the center of the respective cavity, and the intensity decreases in the x direction toward the sides of the cavity. These patterns verify that the single-mode field distribution predicted by the model was present in the cavities.

Figure 22A:
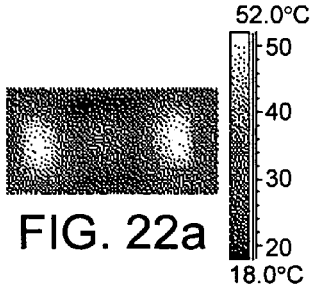
FIGS. 22*a* and 22*b* show experimental power-deposition profiles over a surface of a food package placed in a rectangular cavity when surrounded by air (FIG. 22*a*) and when immersed in water (FIG. 22*b*).
Figure 22B:
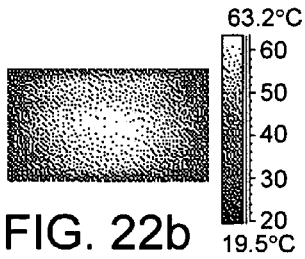

To find the absorbed power-deposition pattern for an actual food-engineering model, a whey-gel slab having dimensions of 140 mm in the x direction, 100 mm in the y direction, and 30 mm in the z direction was heated in a cavity having dimensions of a1=2.0a, b1=1.5b, and z1=100 mm. The experimental power-deposition characteristics over the top surface (in an x-y plane) of the whey-gel slab in air and immersed in water are shown in FIGS. 22*a* and 22*b*, respectively. Comparing FIGS. 20*a* and 22*a*, whenever whey-gel slab is surrounded by air, both the simulated and experimental results have similar patterns.

Comparing FIGS. 20*b* and 22*b*, whenever the whey-gel slab is immersed in water, a slight deviation between the simulated and experimental power-deposition patterns exists. As observed in both cases, the hot zone was at the center of the whey-gel slab and the density of absorbed power decreased in the x direction toward the edges of the whey-gel slab. However, in the computer simulation some overheating occurred at the edges of the load that extend along the width of the load (i.e., the edges that extend in the y direction). Such overheating was not visible in the experimental findings (FIG. 22*b*). This slight disagreement between the model prediction and the experimental findings may have been due to preferential heat conduction into the surrounding medium, as well as radiative and conductive cooling while the whey-gel slab was being moved from the cavity to the infrared camera location.

Example 4

Simulated Return Loss of a Rectangular Cavity

The S-parameter, $S_{11}$, illustrates the return loss and efficiency of a cavity. The $S_{11}$ parameter was computed using QuickWave-3D software in the frequency spectrum of 700 to 1200 MHz for cavities having a length a1 of 2.0a, a width b1 of 1.5b, and depths of 100 mm, 150 mm, and 200 mm. For each cavity, the $S_{11}$ parameter was computed for the empty cavity, while heating a food package, and while heating a food package immersed in water.

Figure 23A:
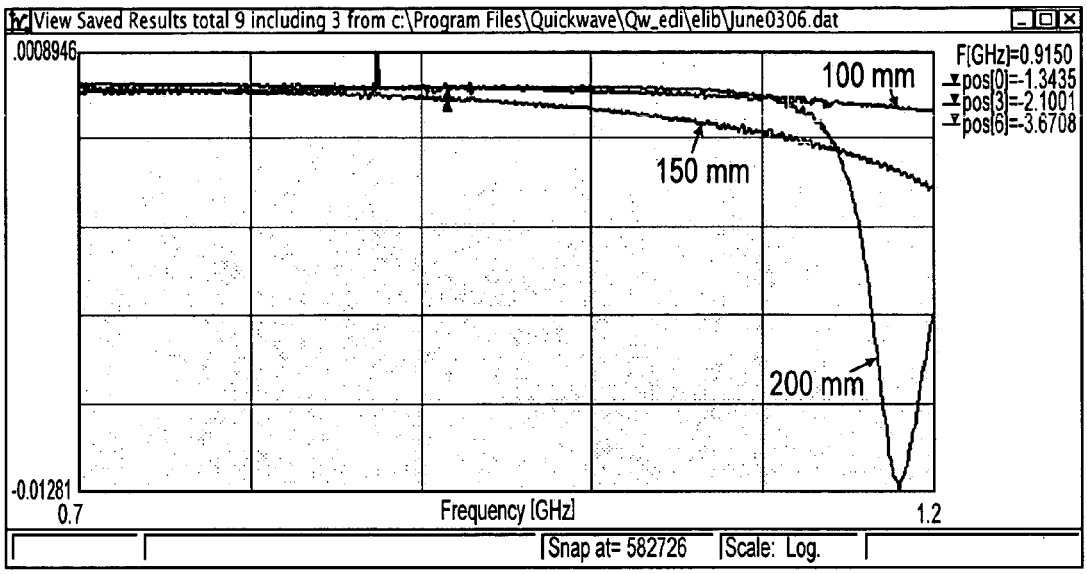
FIGS. 23*a*–23*d* show the return loss of different cavities in the frequency range of 700 to 1200 MHz under different operating conditions.

FIG. 23*a*, which is a screen shot captured directly from the QuickWave-3D simulator, shows the return-loss behavior (the $S_{11}$ parameter, in dB) within the frequency spectrum of 700 to 1200 MHz for each cavity depth when the cavities are empty. As shown, the resonant mode for each cavity is in the high end of the spectrum. As the depth of the cavity increases, the resonant frequency gradually shifts toward the lower end of the frequency spectrum.

Figure 23B:
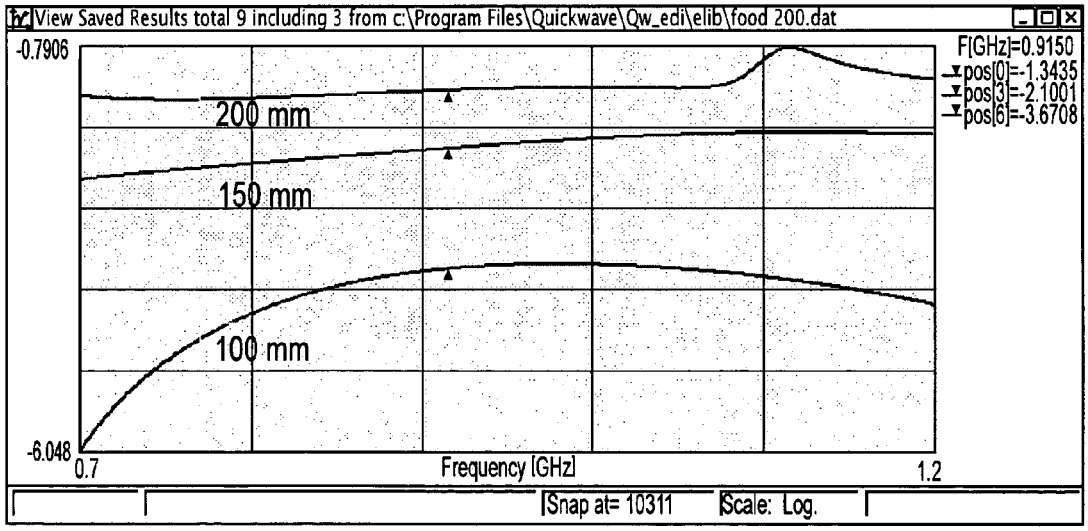

FIG. 23*b* shows the return-loss behavior (the $S_{11}$ parameter, in dB) within the frequency spectrum of 700 to 1200 MHz for each cavity depth when a load is placed in the middle of each cavity. As shown, the return loss decreases as the cavity depth decreases. For example, for the cavity having a depth of 100 mm, the reflected power at 915 MHz is 3.67 dB, which is 44% of the incident power. For the cavity having a depth of 200 mm, the reflected power at 915 MHz is 73% of the incident power.

Figure 23C:
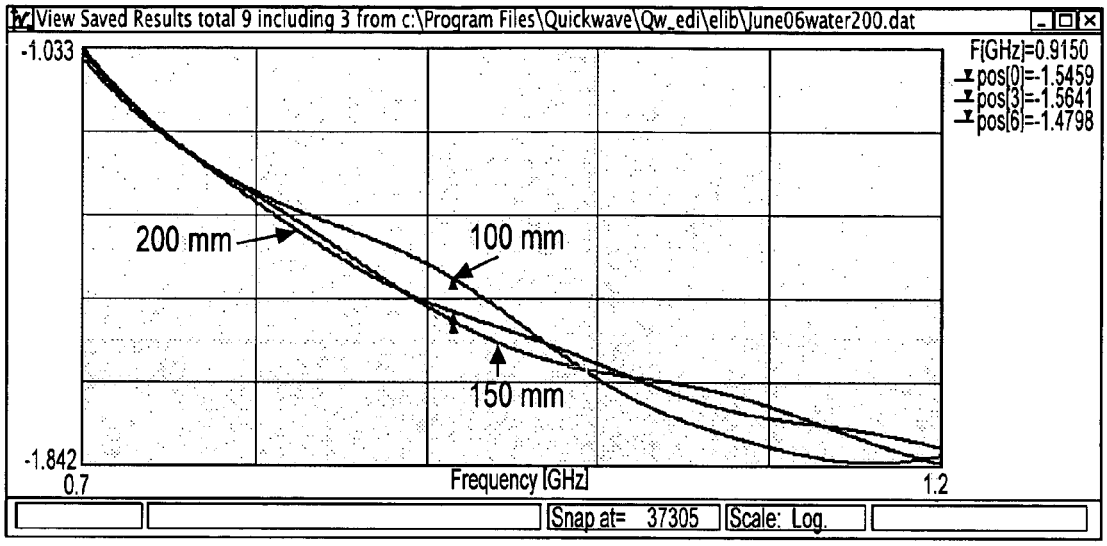

FIG. 23*c* shows the return-loss behavior (the $S_{11}$ parameter, in dB) within the frequency spectrum of 700 to 1200 MHz for each cavity depth when a load is placed in the middle of each cavity and the load is immersed in water. As illustrated in FIG. 23*c*, the presence of water increased the return-loss. For each cavity, the reflected power at 915 MHz is about 70% of the incident power.

Figure 23D:
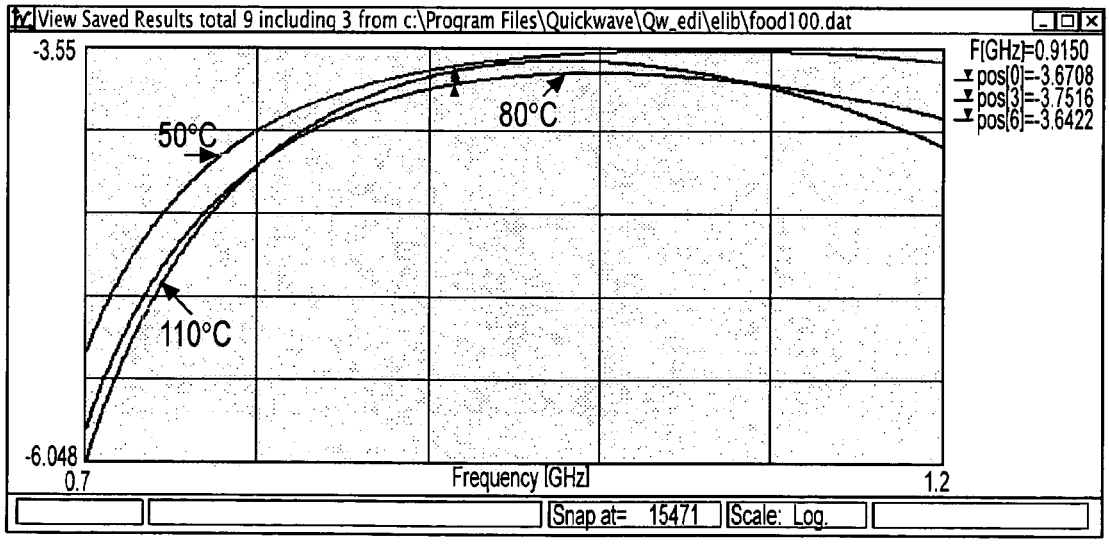

FIG. 23*d* shows the return-loss behavior (the $S_{11}$ parameter, in dB) in the cavity having a depth of 100 mm at 50° C., 80° C., and 110° C. when the load is surrounded by air. The complex permittivity values of the load at 50° C., 80° C., and 110° C. are 47−j38.547, 45.343−j48.568, and 42.597−j60.669, respectively. From FIG. 23*d*, it is observed that the temperature of the load food only slightly effects the return loss.

Example 5

Computer Simulation of a Horn-Shaped Applicator and Rectangular Cavity

In this example, computer modeling is used to demonstrate the field-distribution and wave-propagation characteristics in various microwave systems having horn-shaped microwave applicators. Computer modeling is also used to demonstrate the power-distribution profile over a load (e.g., a food package) irradiated by microwaves in such systems.

In the computer simulations described in this example, rectangular waveguides having an a dimension of 247.65 mm and a b dimension of 123.825 mm (FIGS. 3 and 14*a*) were used to couple a 915-MHz microwave source to respective microwave applicators. The dimensions of the microwave applicators at their enlarged ends were 2.25a (557.21 mm) in the x-direction, 1.5b (185.375 mm) in the y-direction, and 300 mm in the z-direction (FIG. 3). The flare angles $\theta_x$ and $\theta_y$ of the microwave applicators were 17.2° and 5.89°, respectively (FIGS. 4 and 5). In each simulation, a load was immersed in water inside a rectangular cavity having a length of 2.25a (557.21 mm) in the x-direction, a width of 1.5b (185.375 mm) in the y-direction, and a depth of 80 mm in the z-direction.

The computer models for the systems in this example were incremented into cubic cells using Equation 1 above. The dimensions of the load in each simulation were 140 mm, 100 mm, and 30 mm in the x, y and z directions, respectively.

Figure 24A:
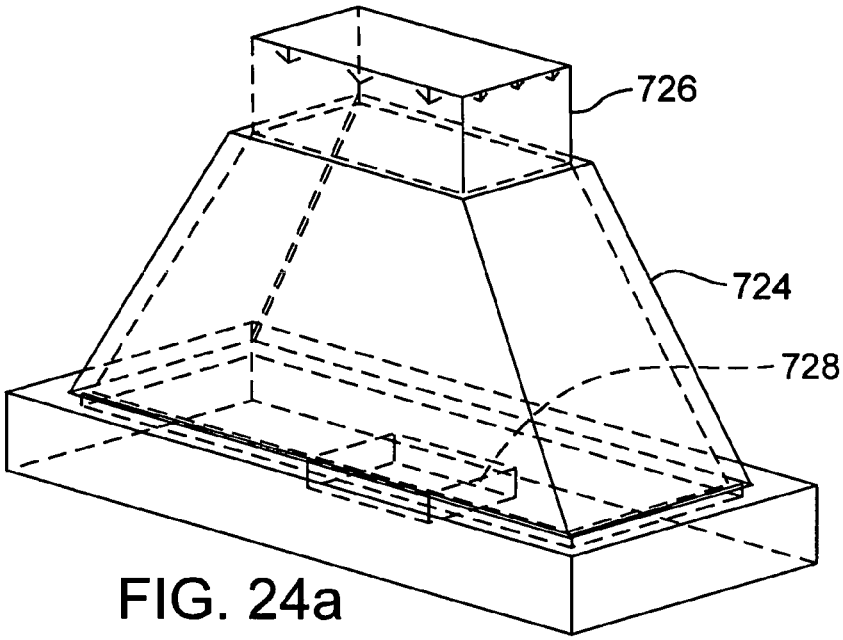
FIG. 24*a* is a schematic illustration of a system having a horn-shaped applicator coupling a rectangular waveguide to a rectangular microwave cavity.
Figure 24B:
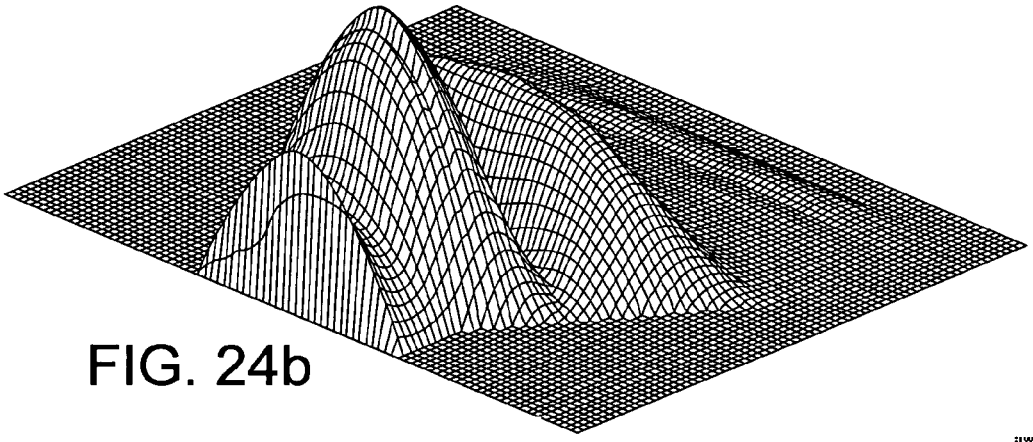
FIG. 24*b* is a computer simulation of the propagation characteristics of the fundamental mode in the applicator and waveguide shown in FIG. 24*a*.

Referring to FIG. 24*a*, a computer simulation was first performed on a system 720 comprising a water-filled cavity 722, a horn-shaped applicator 724, and a rectangular waveguide 726, with a load 728 positioned in the cavity 722. FIG. 24*b* is a snap shot of the fundamental $TE_{10}$-mode propagation through the system 720. From FIG. 24*b*, it can be seen that microwave energy at the mouth (the enlarged outlet end) of the applicator 724 was confined in half-sinusoidal distributions, that is, in the $TE_{10}$-mode distribution. The peak microwave-energy distribution at the outlet end of the applicator 724 was flatter than the energy distribution at the outlet of the rectangular waveguide 726. As discussed below, this resulted in a more uniform absorbed power distribution over the top and bottom surfaces of the load.

Figure 25A:
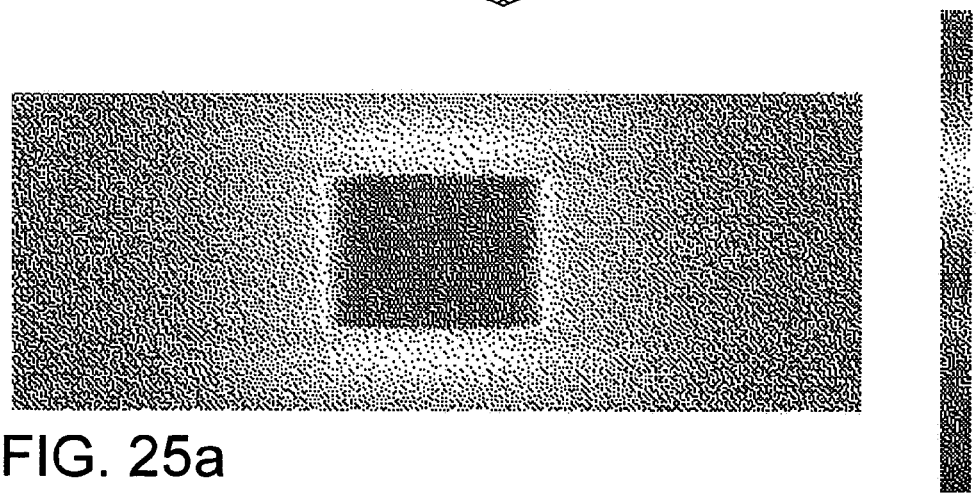
FIG. 25*a* is a computer simulation of the power-deposition profile over the top surface of a load heated in the cavity of FIG. 24*a*.

FIGS. 25*a* and 25*b* show the power-deposition profile over the top surface (the surface closest to the applicator 724) and the bottom surface (in respective x-y planes), respectively, of the load 728. As shown, the absorbed-power distribution is generally symmetrical with respect to the middle cell over the top and bottom surfaces in both the x and y directions. FIG. 26 shows the absorbed-power distribution as a function of depth of the load 728 (in the direction of wave propagation) for different cells ranging from the left side to the middle region of the load. As observed in FIG. 25*a*, the concentration of the electric field lines at the center region of the top surface was greater than at the side edges of the load extending in the x direction. The absorbed-power ratio over the top surface (i.e., the ratio of the absorbed power in the hot region to the absorbed power in the cold region) was 1.5:1. Power absorption decreased through the depth of the load, and the absorbed power at the bottom surface was about 15 to 26 time less than at the top surface, as shown in FIG. 26.

Referring to FIG. 27, computer simulations were performed for a system 750 comprising a water-filled microwave cavity 752 having a load 758 placed therein, first and second microwave applicators 754 positioned on opposing sides of the cavity 752, and rectangular waveguides 756 directing microwaves to the applicators 754. In these simulations, two waves of the same frequency and equal power were excited from opposite directions into the cavity 752 in the $TE_{10}$ mode. As shown in FIGS. 28*a*, 28*b*, 29*a*, 29*b*, 30*a*, and 30*b*, the waves propagated in opposite directions in the z direction, and deposited their power throughout the volume of the load 758. The waves also interacted/interfered with each other along the propagation direction (i.e., in the z direction).

Figure 28A:
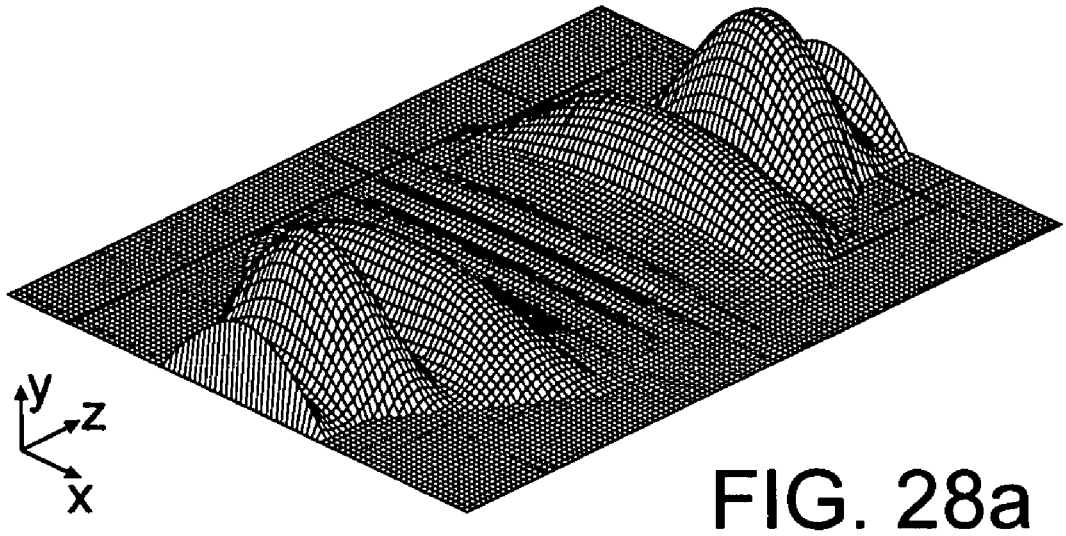
FIG. 28*a* is a computer simulation of the propagation characteristics of the fundamental mode in the system shown in FIG. 27 when the waves from the opposing applicators are in the same phase.
Figure 28B:
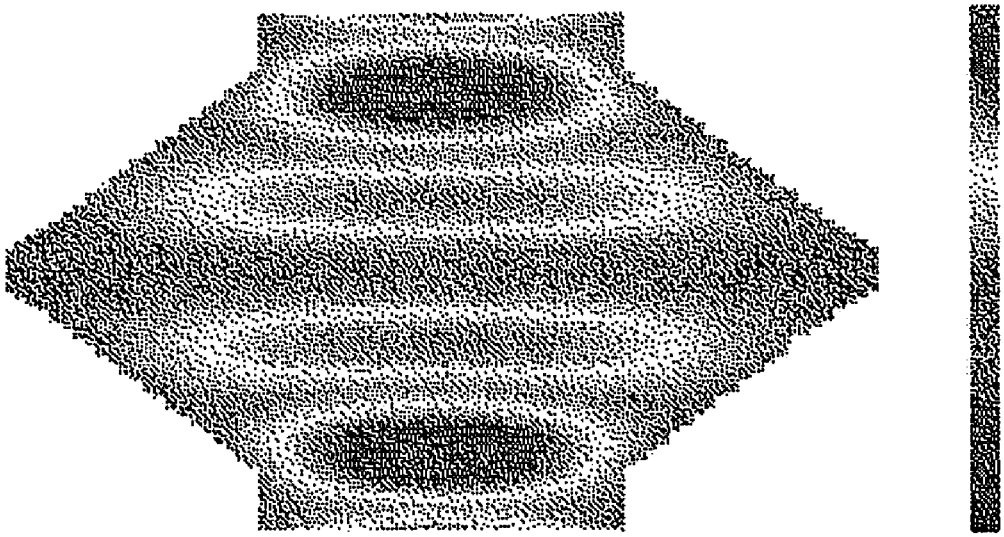
FIG. 28*b* is a computer-simulated thermal representation of the fundamental mode in the system of FIG. 27 when the waves from the opposing applicators are in the same phase.
Figure 34:
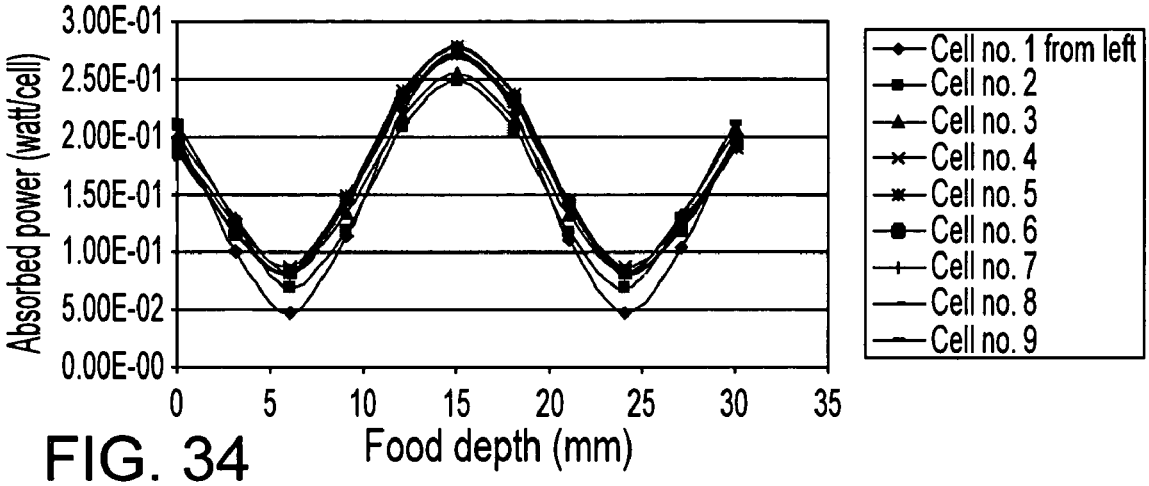
FIGS. 34–37 show the simulated absorbed-power distribution across the depth of the load heated in the system of FIG. 27 for various operating conditions.

In one simulation, waves from opposing applications 754 were propagated through the system 750 (FIG. 27) in the z direction in the same phase (i.e., a 0° phase difference). FIG. 28*a* shows a vector snap shot of the fundamental $TE_{10}$-mode propagation through the system 750 whenever the opposing waves are propagating toward each other in the same phase. From FIG. 28*a*, it can be seen that the amplitude of the electric field is greater in the applicators 754 and waveguides 756 than in the cavity 752. Also, a standing-wave pattern is produced in the applicators 754 and waveguides 756. These characteristics are more pronounced in FIG. 28*b*, which shows the thermal-mode representations of the $TE_{10}$-mode wave propagation. The absorbed-power distribution over the top and bottom surfaces (in respective x-y planes) of the load 758, shown in FIGS. 31*a* and 31*b*, respectively, were similar (i.e., the top and bottom surfaces of the load 758 absorbed approximately the same amount of power). The power-deposition ratio over the top and bottom surfaces was about 1.4:1; that is, the hot region over the top and bottom surfaces absorbed about 1.4 times more power than the cold region. The absorbed-power deposition along the depth of the load 758, shown in FIG. 34 (showing the absorbed-power deposition for different cell locations), was greater at the center portion of the load 758 than at the top and bottom surfaces. In addition, there was a decrease in absorbed power between the middle region and each of the top and bottom surfaces of the load. This standing-wave pattern across the depth of the load was due to the interference of the two waves propagating in opposite directions. The absorbed-power ratio along the depth of the load was about 5:1. As demonstrated by the foregoing, the system 750 (FIG. 27), which has two opposing applicators, provided a more uniform power deposition along the depth of the load than the system 720 (FIG. 24*a*), which has only one applicator.

Figures 31A, 31B, 32A, 32B:
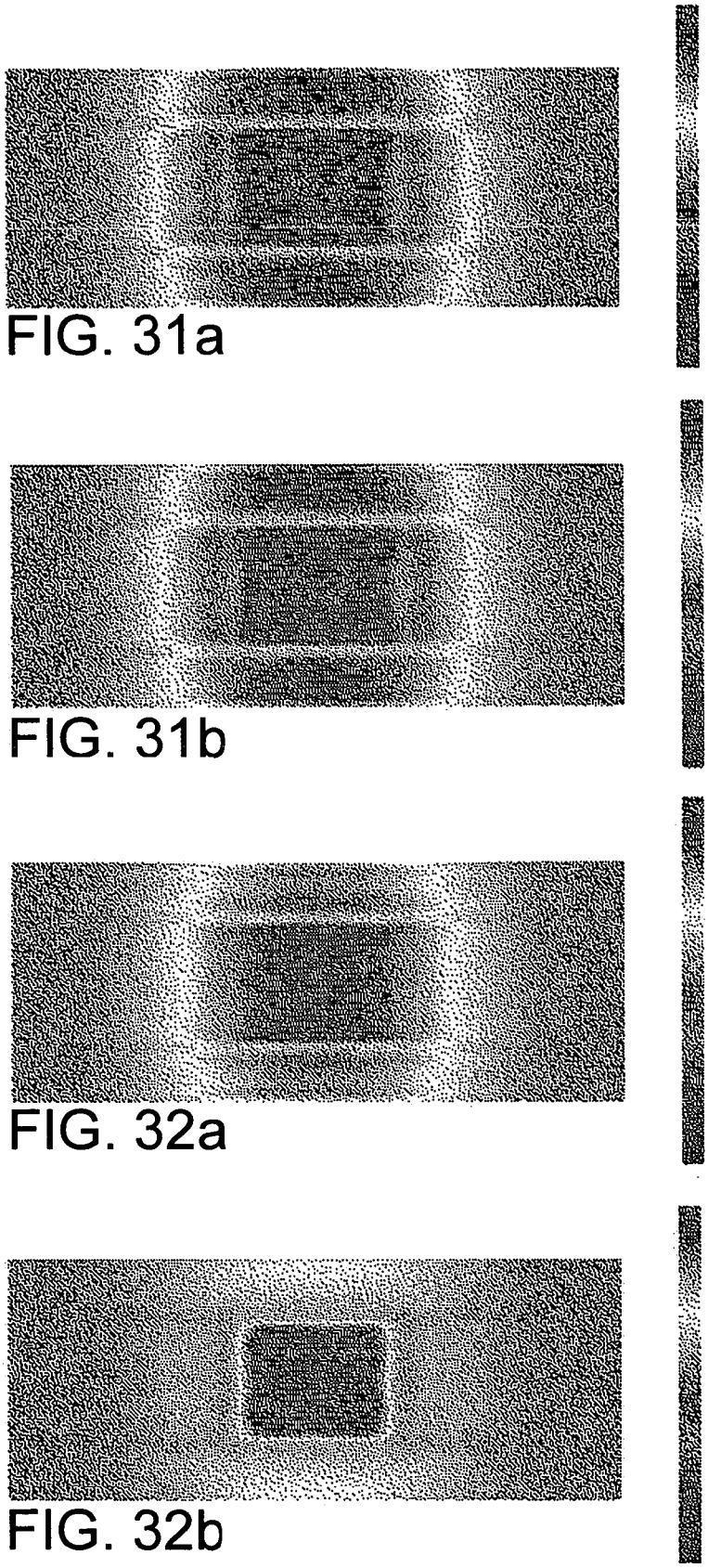
FIGS. 31*a* and 31*b* are computer-simulated power-deposition profiles over the top surface (FIG. 31*a*) and bottom surface (FIG. 31*b*) of a load heated in the system of FIG. 27 when the waves from the opposing applicators are in the same phase.
FIGS. 32*a* and 32*b* are computer-simulated power-deposition profiles over the top surface (FIG. 32*a*) and bottom surface (FIG. 32*b*) of a load heated in the system of FIG. 27 when there is a 90° phase difference between the waves from the opposing applicators.
Figure 35:
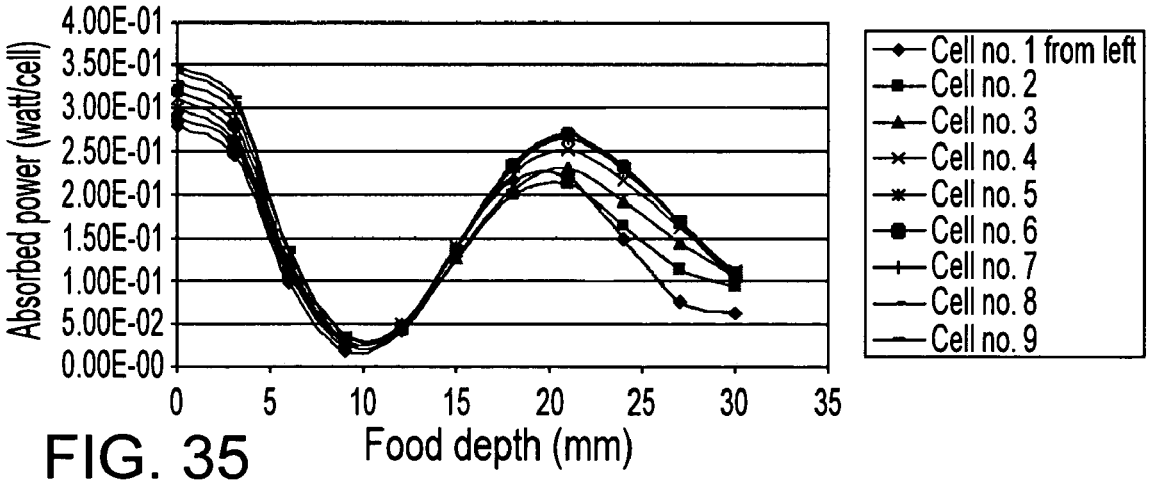

In another simulation, waves were propagated through the system 750 (FIG. 27) in the z direction with a 90° phase difference between the waves. FIGS. 29*a* and 29*b* show the hilltop and thermal representation of the $TE_{10}$-mode wave-propagation characteristics, respectively, through the system 750 for this simulation. The absorbed-power distribution over the top and bottom surfaces (in respective x-y planes) of the load 758 are shown in FIGS. 32*a* and 32*b*, respectively. The absorbed-power distribution along the depth of the load 758, shown in FIG. 35, was greater at the top surface of the load than at the bottom surface, and reached a minimum at a depth of about 8 to 12 mm. The difference between the absorbed-power distribution in this simulation and that for the previous simulation (FIG. 34) is a consequence of the phase difference between the opposing waves.

Figure 33A:
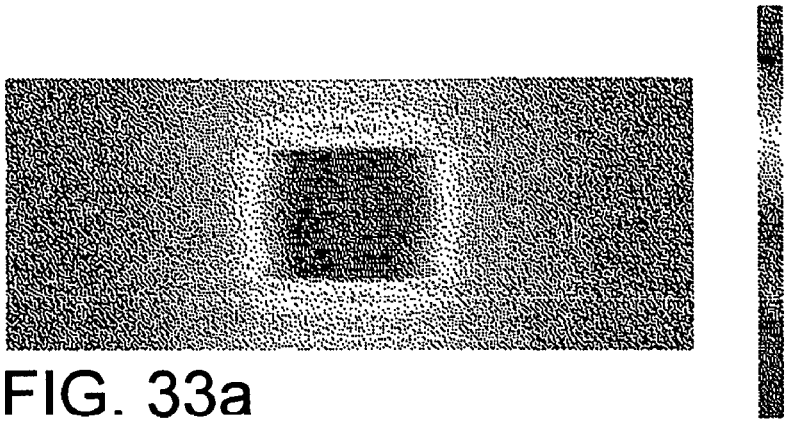
FIGS. 33*a* and 33*b* are computer-simulated power-deposition profiles over the top surface (FIG. 33*a*) and bottom surface (FIG. 33*b*) of a load heated in the system of FIG. 27 when there is a 180° phase difference between the waves from the opposing applicators.
Figure 33B:
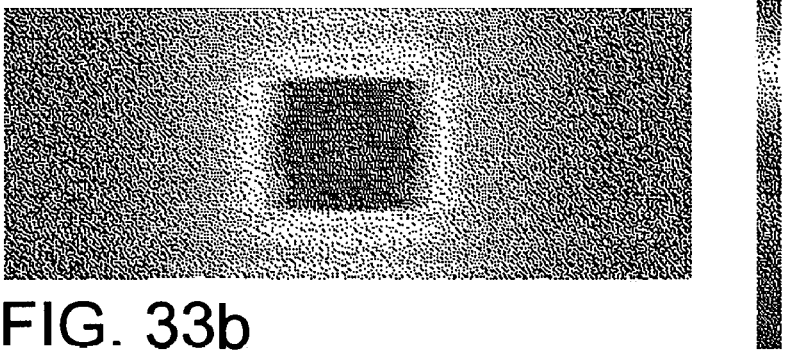
Figure 36:
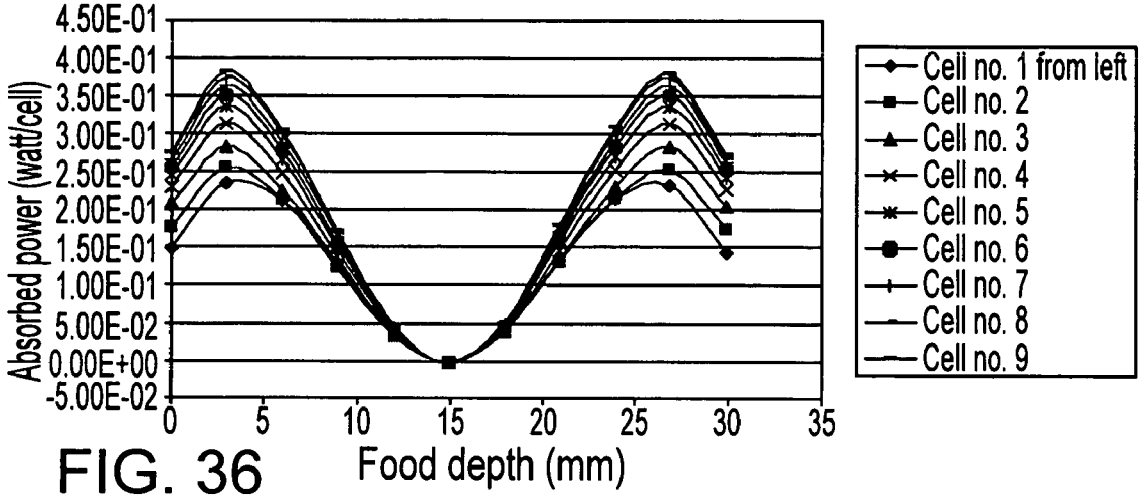

In another simulation, waves were propagated through the system 750 (FIG. 27) in the z direction with a 180° phase difference between the opposing waves. FIGS. 30*a* and 30*b* show the hilltop and thermal representation of the $TE_{10}$-mode wave-propagation characteristics, respectively, through the system 750 for this simulation. As shown in FIGS. 30*a* and 30*b*, the maxima and minima of the opposing waves occur at opposing positions in the system 750. For example, the wave propagating through the top applicator 754 in FIG. 27 reaches a maximum just prior to entering the cavity 752, whereas the wave propagating through the bottom applicator 754 reaches a minimum at the same location in the bottom applicator. The absorbed-power deposition over the top and bottom surfaces (in respective x-y planes) of the load, shown in FIGS. 33*a* and 33*b*, respectively, were similar. The absorbed-power deposition along the depth of the load, shown in FIG. 36, was negligible at the middle of the load. This was due to the fact that, at this location, the opposing waves are completely out of phase, and therefore produced a resultant field of minimal energy.

Figure 37:
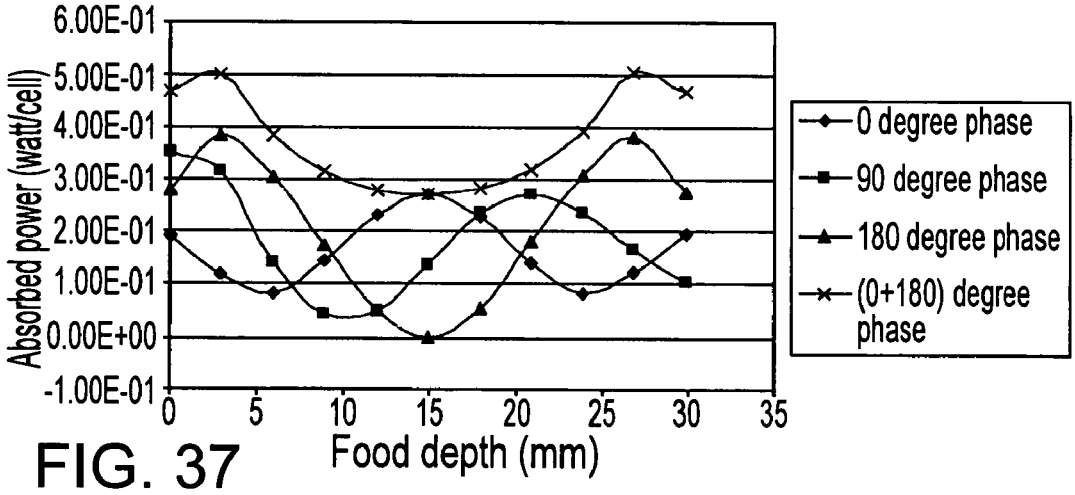

FIG. 37 shows the simulated absorbed-power distribution along the depth of the load at the middle of the x-y plane when there is 0°, 90°, and 180° phase difference between opposing waves. Also plotted in FIG. 37 is the absorbed-power distribution resulting from adding the power distributions corresponding to the waves having 0° and 180° phase differences (without amplitude modification). The absorbed-power ratio for the combined absorbed-power distribution shown in FIG. 37 is about 1.7:1 This heating profile can be achieved by exposing the load to a first pair of applicators configured to provide a 0° phase difference between opposing waves and a second applicator configured to provide a 180° phase difference between opposing waves.

If the relative amplitudes of the absorbed-power distributions are considered, the combined absorbed-power distribution is even more uniform. For example, the absorbed-power distribution resulting from a 180° phase difference has a relative amplitude of about 0.3 and the absorbed-power distribution resulting from a 0 phase difference has a relative amplitude of about 1.0. This results in a combined absorbed-power distribution profile having an absorbed-power ratio of about 1.4:1 along the depth of the load, which is significantly less than the absorbed-power ratios for the distribution profiles shown in FIGS. 34–36 (about 5:1).

Hence, to improve heating uniformity, a load can be exposed to microwaves from a plurality of opposing applicators (e.g., as shown in FIGS. 6, 7, 9, and 11), with each pair of applicators applying microwaves with a selected phase differential.

Example 6

Computer Simulation of a Horn-Shaped Applicator Wave and Rectangular Cavity with Load In this example, computer modeling is used to demonstrate the power-distribution profile over three differently sized loads irradiated by microwaves in the system 750 of FIG. 27. The dimensions selected for the loads were 140 mm×100 mm×30 mm (in the x, y, and z directions respectively); 163 mm×120 mm×28 mm; and 225 mm×170 mm×45 mm. These dimensions were selected as being representative of dimensions of commercially available food packages. The complex permittivity value of the load 758 (FIG. 27) in this example was 47.447–j 38.547, which is representative of macaroni and cheese.

Figure 38A:
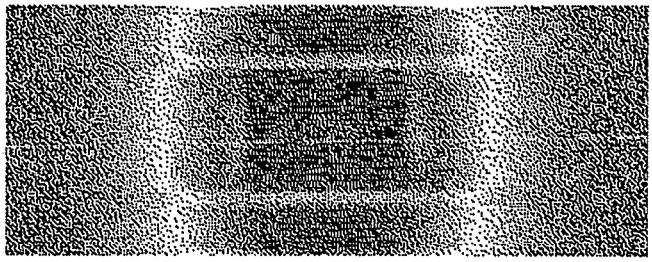
FIGS. 38*a*–38*c* are computer-simulated power-deposition profiles over the top surface of three differently sized loads heated in the system of FIG. 27.
Figure 38B:
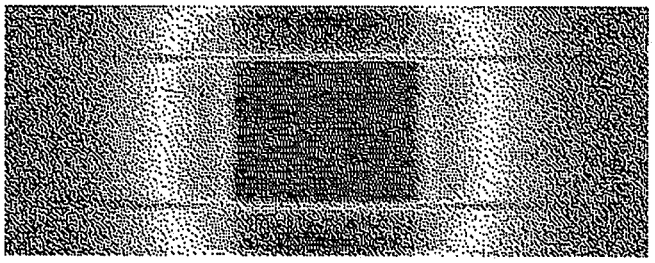
Figure 38C:
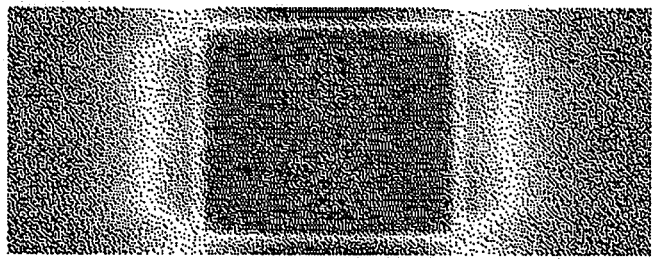

In the simulations of this example, two waves of the same frequency and equal power were excited from opposite directions into the cavity 752 in the $TE_{10}$-mode, as in the previous example. FIG. 38*a* shows the simulated absorbed-power distribution profile over the top surface of the load having the dimensions 140 mm×100 mm×30 mm; FIG. 38*b* shows the simulated absorbed-power distribution profile over the top surface of the load having the dimensions 163 mm×120 mm×28 mm; and FIG. 38*c* shows the simulated absorbed-power distribution profile over the top surface of the load having the dimensions 225 mm×170 mm×45 mm. The results of these simulations demonstrate that the absorbed-power distributions over the top and bottom surfaces of the loads remains almost the same as the horizontal dimensions (the dimensions in the x and y directions) of the loads increased. The absorbed-power-deposition ratio was about 1.4:1 over the top surfaces of the loads, and was about 6:1 along the depth of the loads.

Figure 38D:
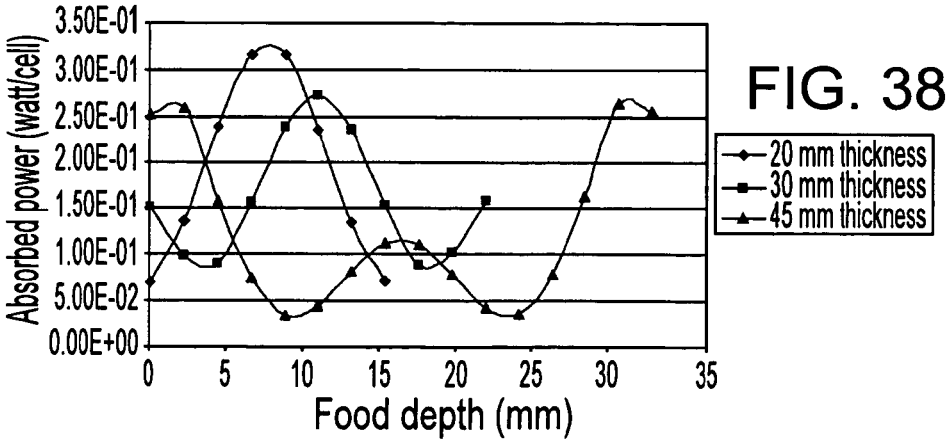
FIG. 38*d* shows the simulated absorbed-power distribution across the depth of the three loads.

FIG. 38*d* shows simulated absorbed-power distributions along the depths of loads having thicknesses of 20 mm, 30 mm, and 45 mm when opposing waves are propagated toward each other in the same phase. As shown, the simulated absorbed-power distributions along the depths of the loads varied significantly between the different loads. For the load having a depth, or thickness, of 20 mm, the center region of the load absorbed the most power, nearly 4.4 times more power than the top and bottom surface of the load. For the load having a depth of 30 mm, the absorbed power was lowest between the center region and the top and bottom surfaces of the load, and the absorbed-power-deposition ratio was 3.0:1. For the load having a depth of 45 mm, the absorbed-power ratio was 7.3:1, and the absorbed power was greatest at the top and bottom surfaces of the load. The variations in absorbed power for the different loads can be attributed in part to the attenuation in power across the depth of the loads.

As the temperature of a foodstuff increases during microwave heating, the complex permittivity of the foodstuff changes with temperature. Computer simulations were performed to demonstrate the effect that the instantaneous temperature of a load has on the power-distribution profile of the load when heated in the system 750 (FIG. 27). In these simulations, two waves of the same frequency and equal power were excited from opposite directions into the cavity 752 in the $TE_{10}$-mode, as in previous example. The dimensions of the load were 140 mm×100 mm×30 mm (in the x, y, and z directions, respectively), and the complex permittivity value of the load was 47.447−j 38.547.

Figure 39E:
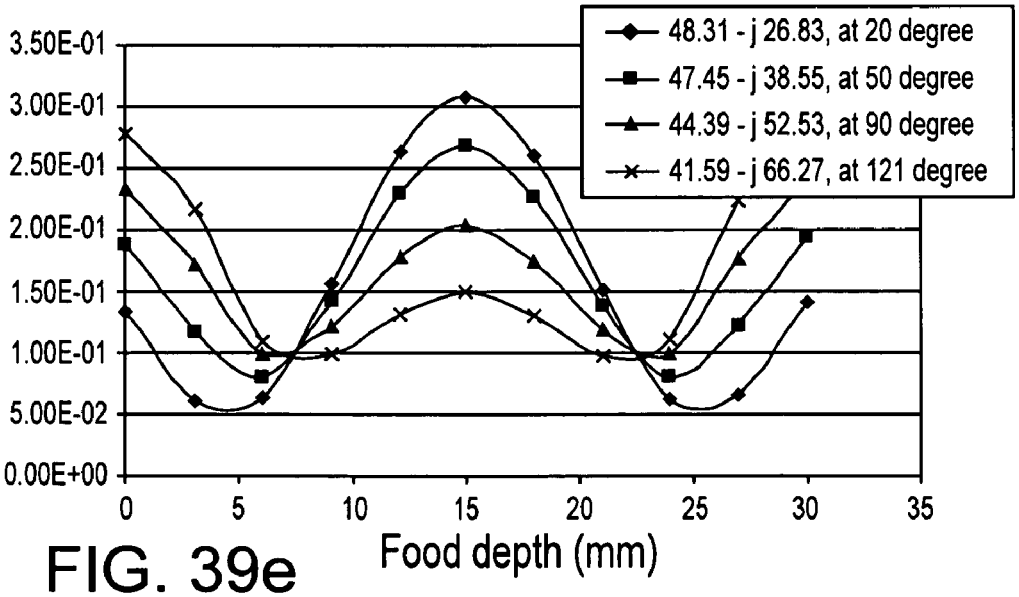
FIG. 39*e* shows the simulated absorbed-power distribution across the depth of the load at all four temperatures.
Figure 39A:
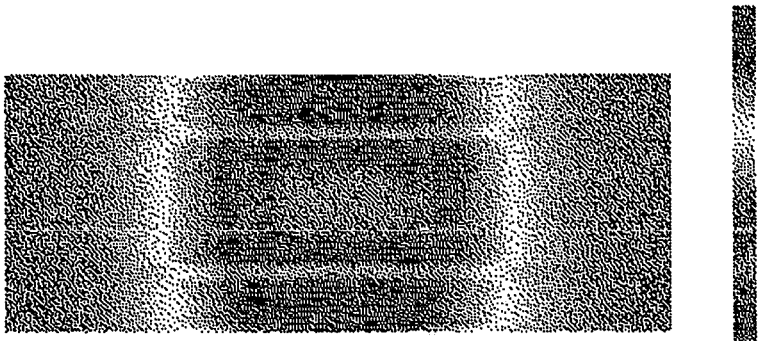
FIGS. 39*a*–39*d* are computer-simulated power-deposition profiles over the top surface of a load at four different temperatures.
Figure 39B:
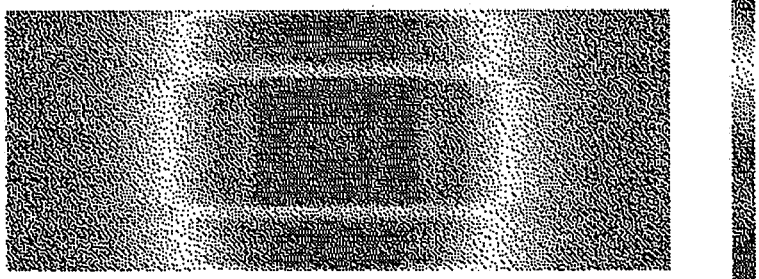
Figure 39C:
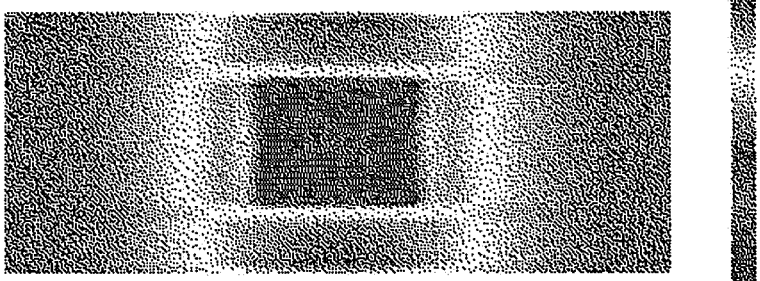
Figure 39D:
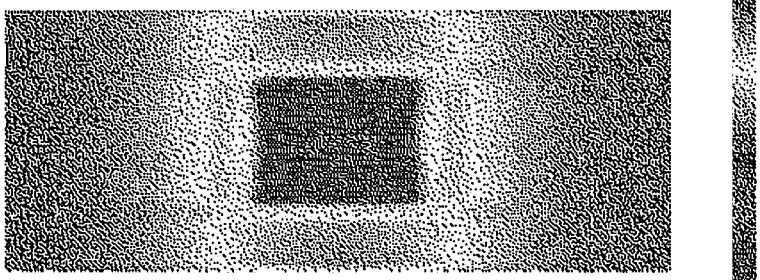

FIGS. 39*a*–39*d* show the distribution of absorbed-power deposition over the top and bottom surfaces of the load (having the dimensions 140 mm×100 mm×30 mm) at four different temperatures (20° C., 50° C., 90° C., and 121° C., respectively) and complex permittivity values. The complex permittivity values at 20° C., 50° C., 90° C., and 121° C. were 48.311−j 26.83, 47.447−j 38.547, 44.386−j 52.533, and 41.587−j 66.273, respectively. These figures show that that absorbed-power distribution remains almost the same at each temperature. For example, the absorbed-power-deposition ratio was 1.48:1 at 20° C. (FIG. 39*a*) and 1.32:1 at 121° C. (FIG. 39*d*).

FIG. 39*e* shows the absorbed-power distribution across the depth of the load for all four temperatures when the opposing waves are in the same phase. The amount of power absorbed by each cell at the top and bottom surfaces of the load increased as the temperature increased, as illustrated in FIG. 39*e*. This can be attributed to the fact that the loss factor (the $\epsilon''$ values) of the load increased as the temperature increased. In addition, the amount of power absorbed at the center of the food package decreased as the temperature increased. This can attributed to the fact that the loss factor of the food material increased as the temperature increased, which caused a corresponding decrease in the penetration depth of the power in the load. The ratio of absorbed-power deposition along the depth of the load was 4.95:1, 3.29:1, 2.39:1, and 3.02:1 at 20° C., 50° C., 90° C., and 121° C., respectively.

Example 7

Simulated Return Loss and Transmission Behavior of Horn-Shaped Applicator

Figure 40A:
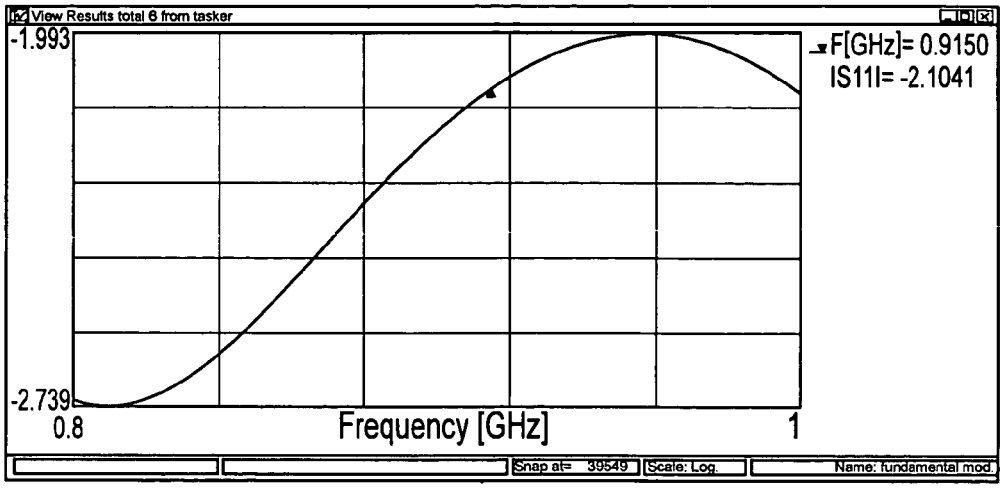
FIGS. 40*a* and 40*b* show the return loss of the system of FIG. 24*a* (FIG. 40*a*) and the system of FIG. 27 (FIG. 40*b*) in the frequency range of 700 to 1200 MHz.

In this example, the QuickWave-3D software program was used to calculate the return loss (the amount of reflected power in the system) of the systems discussed in Examples 5–6. FIG. 40*a* shows a graph of the $S_{11}$ parameter (in dB), or the return loss, of the system 720 shown in FIG. 24*a* within the frequency band of 800 to 1000 MHz. As shown, the resonant mode is in the lower end of the specified frequency spectrum. The return loss gradually increases as the frequency increases and then decreases after peaking at about 960 MHz. The return loss at 915 MHz is 2.104 dB, which is 61.6% of the incident power.

Figure 40B:
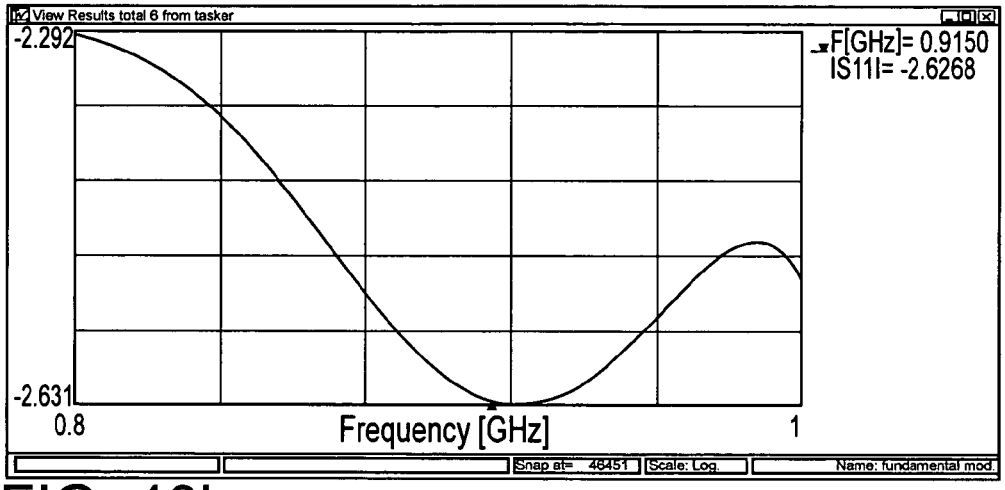
Figure 40C:
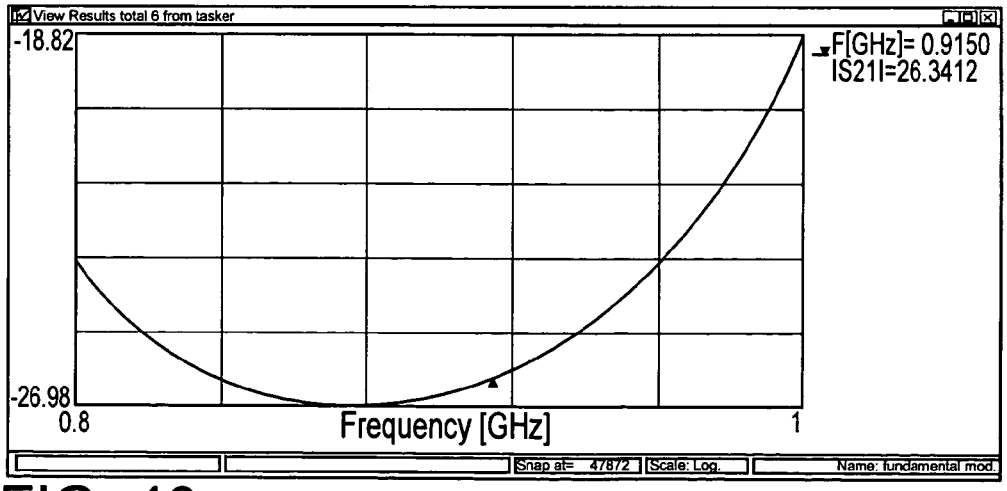
FIG. 40*c* shows the transmission behavior of the system of FIG. 27 (FIG. 40*b*) in the frequency range of 700 to 1200 MHz.

FIG. 40*b* shows a graph of the $S_{11}$ parameter (in dB) for the system 750 shown in FIG. 27 within the frequency spectrum of 800 to 1000 MHz. While computing this parameter, only one applicator 754 was excited. As shown in FIG. 40*b*, the reflected power resonates at about 915 MHz. At this frequency, the reflected power is 2.63 dB, which is about 59% of the incident power. FIG. 40*c* is a graph of the $S_{21}$ parameter (measured in dB) of the system within the frequency range of 800 to 1000 MHz. The $S_{21}$ parameter represents the transmission of microwave energy from one applicator to another. As shown in FIG. 40*c*, the $S_{21}$ parameter at 915 MHz at the non-excited applicator is −26.34 dB, which is about 0.23% of the incident power.

The present invention has been shown in the described embodiments for illustrative purposes only. The present invention may be subject to many modifications and changes without departing from the spirit or essential characteristics thereof. We therefore claim as our invention all such modifications as come within the spirit and scope of the following claims.

We claim:

1. An apparatus for sterilizing a packaged foodstuff utilizing microwaves, the apparatus comprising:

at least one cavity in which the packaged foodstuff is positioned, the cavity being configured to operate as a single-mode cavity for sterilizing the packaged foodstuff whenever microwave energy radiates into the cavity; and first and second waveguides configured to direct microwaves into the cavity in opposite directions, wherein the first waveguide includes a first horn-shaped applicator, and the second waveguide includes a second horn-shaped applicator, the first and second applicators being situated on opposing sides of the cavity for directing microwaves into the cavity in opposing directions.

2. The apparatus of claim 1, wherein the first and second waveguides are configured such that a phase difference exists between the microwaves propagating into the cavity from the first applicator and the microwaves propagating into the cavity from the second applicator.

3. The apparatus of claim 2, wherein there is a 180° phase difference between the microwaves propagating into the cavity from the first applicator and the microwaves propagating into the cavity from the second applicator.

4. An apparatus for sterilizing a packaged foodstuff utilizing microwaves, the apparatus comprising:

at least one cavity in which the foodstuff is positioned, the cavity being configured to operate as a single-mode cavity for sterilizing the foodstuff whenever microwave energy radiates into the cavity; and a waveguide for directing microwaves into the cavity, the waveguide having a cross-sectional area defined by a length and a width, wherein the cavity has cross-sectional area defined by a length and a width, the length of the cavity being equal to or less than twice the length of the waveguide, and the width of the cavity being equal to or less than one and a half times the width of the waveguide.

5. The apparatus of claim 4, wherein the cavity has a depth that is equal to or less than 200 mm.

6. An apparatus for heating an object utilizing microwaves, comprising:

at least one cavity for receiving the object to be heated, the cavity comprising a liquid-tight cavity, the cavity having first and second microwave-transparent windows on opposing sides of the cavity;

at least one waveguide comprising a first applicator and a second applicator, the first applicator being positioned adjacent the first microwave-transparent window for directing microwaves into the cavity in a first direction, and the second applicator being positioned adjacent the second microwave-transparent window for directing microwaves into the cavity in a second direction opposite the first direction; and a pressurized-liquid source configured to deliver a pressurized liquid to the cavity for immersing the object in the liquid during heating.

7. The apparatus of claim 6, wherein the cavity is configured to operate as a single-mode cavity whenever microwaves radiate into the cavity.

8. The apparatus of claim 6, wherein the waveguide is configured such that a phase difference exists between the microwaves entering the cavity from the first applicator and the microwaves entering the cavity from the second applicator.

9. The apparatus of claim 8, wherein a 180° phase difference exists between the microwaves entering the cavity from first applicator and the microwaves entering the cavity from the second applicator.

10. The apparatus of claim 8, wherein a 90° phase difference exists between the microwaves entering the cavity from first applicator and the microwaves entering the cavity from the second applicator.

11. The apparatus of claim 6, wherein the object comprises a foodstuff to be pasteurized or sterilized in the cavity, and the pressurized-liquid source delivers a pre-heated liquid to the cavity that is pre-heated to a pasteurization or sterilization temperature.

12. The apparatus of claim 6, wherein each of the first and second applicators flares from a first cross-sectional area to a greater second cross-sectional area adjacent the cavity.

13. The apparatus of claim 6, wherein:

the at least one cavity comprises at least first and second cavities in communication with each other so that the object to be heated can be moved into each cavity for microwave heating, and the at least one cavity comprises a plurality of cavities in communication with each other so that the object to be heated can be moved into each cavity for microwave heating;

the at least one waveguide comprises a plurality of waveguides, each waveguide comprising a respective pair of first and second applicators for directing microwaves into a respective cavity in opposite directions; and the apparatus further comprises a conveyor mechanism for moving the object into each cavity for microwave heating.

14. The apparatus of claim 6, wherein the microwaves entering the cavity from the first applicator are in the same phase as the microwaves entering the cavity from the second applicator.

15. The apparatus of claim 6, wherein:

the at least one waveguide comprises at least first and second waveguides, the first waveguide comprising first and second applicators configured to direct microwaves into the first waveguide in opposite respective directions, the second waveguide comprising first and second applicators configured to direct microwaves into the second cavity in opposite respective directions.

16. The apparatus of claim 15, wherein at least the first and second applicators of the first waveguide are configured such that a phase difference exists between the microwaves directed into the first cavity by the first and second applicators.

17. The apparatus of claim 16, wherein the first and second applicators of the first and second waveguides are configured such that a phase difference exists between the microwaves directed into the first cavity and between the microwaves directed into the second cavity.

18. The apparatus of claim 17, wherein the phase difference between the microwaves directed into the first cavity is different than the phase difference between the microwaves directed into the second cavity.

19. The apparatus of claim 15, wherein the first and second applicators of the first waveguide are configured such that no phase difference exists between the microwaves directed into the first cavity and the first and second applicators of the second waveguide are configured such that a phase difference exists between the microwaves directed into the second cavity.

* * * * *

UNITED STATES PATENT AND TRADEMARK OFFICE

CERTIFICATE OF CORRECTION

PATENT NO. : 7,119,313 B2
APPLICATION NO. : 10/937547
DATED : October 10, 2006
INVENTOR(S) : Tang et al.

It is certified that error appears in the above-identified patent and that said Letters Patent is hereby corrected as shown below:

In the Specification:

Column 15, line 47, "$E_y$" should be --$E_z$--

In the Claims:

Column 25, line 33, "13. The apparatus of claim 6, wherein:
the at least one cavity comprises at least first and second cavities in communication with each other so that the object to be heated can be moved into each cavity for microwave heating; and
the at least one cavity comprises a plurality of cavities in communication with each other so that the object to be heated can be moved into each cavity for microwave heating;
the at least one waveguide comprises a plurality of waveguides, each waveguide comprising a respective pair of first and second applicators for directing microwaves into a respective cavity in opposite directions; and
the apparatus further comprises a conveyor mechanism for moving the object into each cavity for microwave heating."

Should be: --13. The apparatus of claim 6, wherein:
the at least one cavity comprises a plurality of cavities in communication with each other so that the object to be heated can be moved into each cavity for microwave heating;
the at least one waveguide comprises a plurality of waveguides, each waveguide comprising a respective pair of first and second applicators for directing microwaves into a respective cavity in opposite directions; and
the apparatus further comprises a conveyor mechanism for moving the object into each cavity for microwave heating.--

Column 26, line 12, "15. The apparatus of claim 6, wherein:
the at least one waveguide comprises at least first and second waveguides, the first waveguide comprising first and second applicators configured to direct microwaves into the first waveguide in opposite respective directions, the second waveguide comprising first and second applicators configured to direct microwaves into the second cavity in opposite respective directions."

Should be: --15. The apparatus of claim 6, wherein:
the at least one cavity comprises at least first and second cavities in communication with each other so that the object to be heated can be moved into each cavity for microwave heating, and

UNITED STATES PATENT AND TRADEMARK OFFICE

CERTIFICATE OF CORRECTION

PATENT NO. : 7,119,313 B2
APPLICATION NO. : 10/937547
DATED : October 10, 2006
INVENTOR(S) : Tang et al.

It is certified that error appears in the above-identified patent and that said Letters Patent is hereby corrected as shown below:

the at least one waveguide comprises at least first and second waveguides, the first waveguide comprising first and second applicators configured to direct microwaves into the first waveguide in opposite respective directions, the second waveguide comprising first and second applicators configured to direct microwaves into the second cavity in opposite respective directions.--

Signed and Sealed this

Eleventh Day of November, 2008

JON W. DUDAS
*Director of the United States Patent and Trademark Office*